US011085689B2

(12) United States Patent
Kim et al.

(10) Patent No.: US 11,085,689 B2
(45) Date of Patent: Aug. 10, 2021

(54) CONTROL METHOD FOR REFRIGERATOR

(71) Applicant: LG Electronics Inc., Seoul (KR)

(72) Inventors: Hosan Kim, Seoul (KR); Sunghee Kang, Seoul (KR); Jindong Kim, Seoul (KR); Jeongwon Park, Seoul (KR); Namgyo Lee, Seoul (KR); Jihyun Im, Seoul (KR); Namsoo Cho, Seoul (KR); Yonghyeon Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 388 days.

(21) Appl. No.: 16/087,872

(22) PCT Filed: Mar. 24, 2017

(86) PCT No.: PCT/KR2017/003232
§ 371 (c)(1),
(2) Date: Sep. 24, 2018

(87) PCT Pub. No.: WO2017/164711
PCT Pub. Date: Sep. 28, 2017

(65) Prior Publication Data

US 2020/0300530 A1 Sep. 24, 2020

(30) Foreign Application Priority Data

Mar. 24, 2016 (KR) ..... 10-2016-0035198
Feb. 20, 2017 (KR) ..... 10-2017-0022528

(51) Int. Cl.
*F25D 11/02* (2006.01)
*F25D 17/04* (2006.01)
(Continued)

(52) U.S. Cl.
CPC ..... *F25D 11/02* (2013.01); *F25D 17/045* (2013.01); *F25D 17/065* (2013.01);
(Continued)

(58) Field of Classification Search
CPC ..... F25D 11/02; F25D 11/022; F25D 17/045; F25D 2600/06
See application file for complete search history.

(56) References Cited

U.S. PATENT DOCUMENTS 5,931,004 A 8/1999 Yoo et al.
5,983,654 A * 11/1999 Yamamoto ..... F25D 17/065 62/187
(Continued)

FOREIGN PATENT DOCUMENTS

CN 2739542 11/2005
KR 1019920007626 9/1992
(Continued)

OTHER PUBLICATIONS

Machine translation of KR 100382503 to LG Electronics, eSPacenet, all May 9, 2003 (Year: 2003).*
(Continued)

*Primary Examiner* — Filip Zec
(74) *Attorney, Agent, or Firm* — Fish & Richardson P.C.

(57) ABSTRACT

A control method for a refrigerator comprises driving a first cooling fan to cool a first storage chamber; adjusting a damper to cause cold air to simultaneously flow through first and second cold-air passages; adjusting a damper to reduce the opening angle of the first cold-air passage, when the temperature of a high-temperature chamber reaches a value smaller than or equal to a second reference temperature for the high-temperature chamber; adjusting a damper to reduce the opening angle of the second cold-air passage, when the temperature of a low-temperature chamber reaches a value smaller than or equal to a second reference temperature for the low-temperature chamber; and driving a second cooling fan to cool a second storage chamber. When a predetermined time elapses or the sensed temperature of the high-tempera-
(Continued)

ture chamber reaches a first set temperature, the damper is adjusted to increase the opening angle of the first cold-air passage.

19 Claims, 18 Drawing Sheets

(51) Int. Cl.
*F25D 17/06* (2006.01)
*F25D 17/08* (2006.01)
*F25D 29/00* (2006.01)

(52) U.S. Cl.
CPC ..... *F25D 17/067* (2013.01); *F25D 17/08* (2013.01); *F25D 29/003* (2013.01); *F25D 2300/00* (2013.01); *F25D 2317/063* (2013.01)

(56) References Cited

U.S. PATENT DOCUMENTS 5,992,165 A * 11/1999 Kim ..... F25D 17/045 62/187
7,775,058 B2 * 8/2010 Kaga ..... F25D 21/04 62/228.4
9,140,477 B2 * 9/2015 Gomes ..... F25B 49/02
2003/0097850 A1 5/2003 Chang et al.

FOREIGN PATENT DOCUMENTS

KR 100382503 5/2003
KR 1020050000616 9/2005
KR 101210751 12/2012
KR 1020150032105 3/2015

OTHER PUBLICATIONS

Chinese Office Action in Chinese Application No. 201780019233.8, dated Sep. 11, 2020, 12 pages (with English translation).
Extended European Search Report in European Application No. 17770681.6, dated Sep. 27, 2019, 9 pages.
International Search Report in International Application No. PCT/KR2017/003232, dated Jul. 17, 2017, 4 pages.

* cited by examiner

| THREE-WAY VALVE | SECOND STATE | | THIRD STATE | |
|---|---|---|---|---|
| FIRST DAMPER | OPEN | CLOSE | OPEN (ADDITIONAL OPTION) | CIRCULATION OPERATION |
| SECOND DAMPER | OPEN | | CLOSE | CIRCULATION OPERATION |

| THREE-WAY VALVE | SECOND STATE | | | THIRD STATE | |
|---|---|---|---|---|---|
| FIRST DAMPER | OPEN | CLOSE | OPEN | CLOSE | CIRCULATION OPERATION (OPEN AND CLOSE REPEAT) |
| SECOND DAMPER | OPEN | | | CLOSE | CIRCULATION OPERATION (OPEN AND CLOSE REPEAT) |

CONTROL METHOD FOR REFRIGERATOR

CROSS-REFERENCE TO RELATED APPLICATIONS

This application is a National Stage application under 35 U.S.C. § 371 of International Application No. PCT/KR2017/003232, filed on Mar. 24, 2017, which claims the benefit of Korean Application No. 10-2017-0022528, filed on Feb. 20, 2017, and Korean Application No. 10-2016-0035198, filed on Mar. 24, 2016. The disclosures of the prior applications are incorporated by reference in their entirety.

TECHNICAL FIELD

The present invention relates to a control method for a refrigerator.

BACKGROUND ART

Refrigerators are devices for storing foods stored therein at a low temperature by using cold air generated by a refrigeration cycle in which processes of compression-condensation-expansion-evaporation are continuously performed.

The refrigeration cycle includes a compressor for compressing a refrigerant, a condenser for condensing the refrigerant in a high-temperature and high-pressure state compressed by the compressor through heat radiation, and an evaporator for cooling surrounding air through a cooling action for absorbing latent heat around the refrigerant while evaporating the refrigerant supplied from the condenser. A capillary tube (or an expansion valve) is provided between the condenser and the evaporator to increase a flow rate of the refrigerant and reduce a pressure so that the evaporation of the refrigerant flowing into the evaporator easily occurs.

FIG. 1 is a front view illustrating an example of a refrigerator 1, and FIG. 2 is a conceptual view illustrating a state in which a door 12 of the refrigerator 10 of FIG. 1 is opened.

As illustrated in FIGS. 1 and 2, a refrigerator body 11 has at least one storage space for storing foods therein. When a plurality of storage spaces are provided, the storage spaces may be separated from each other by a partition wall and be maintained at different set temperatures.

In the drawings, first and second refrigerating compartments 11*a* and 11*b* and a freezing compartment 11*c* are provided in the refrigerator body 11. As illustrated in the drawings, the first and second refrigerating compartments 11*a* and 11*b* and the freezing compartment 11*c* may be successively disposed upward.

A door 12 is connected to the refrigerator body 11 to open and close a front opening of the refrigerator body 11. The door 12 may be variously provided as a rotatable door that is rotatably connected to the refrigerator body 11 and a drawer-type door that is slidably movably connected to the refrigerator body 11.

In the drawings, first and second refrigerating compartment doors 12*a* and 12*b* and the freezing compartment door 12*c* open and close front surfaces of first and second refrigerating compartments 11*a* and 11*b* and a freezing compartment 11*c*, respectively. As illustrated in the drawings, each of the first and second refrigerating compartment doors 12*a* and 12*b* and the freezing compartment door 12*c* may be provided as the rotatable door, and the second refrigerating compartment door 12*b* may be provided as the drawer-type door.

The first refrigerating compartment door 12*a* may include a main door 12*a*' and a sub door 12*a*". The main door 12*a*' may be rotatably connected to the refrigerator body 11 to open and close the first refrigerating compartment 11*a*, and the sub door 12*a*" may be rotatably connected to the main door 12*a*" to open and close an opening of the main door 12*a*'. An accommodation part 13 for storing foods may be provided in at least one of the main door 12*a*' or the sub door 12*a*", and a user may be accessible to the accommodation part 13 by only opening the sub door 12*a*". Thus, user's convenience and energy efficiency may be improved.

At least one accommodation unit 13 [for example, a shelf, 13*a*, a tray 13*b*, a basket 13*c*, and the like] may be provided in the refrigerator body 11 to efficiently utilize an internal storage space. For example, the shelf 13*a* and the tray 13*b* may be installed in the refrigerator body 11, and the basket 13*c* may be connected to the refrigerator body 11 and installed inside the door 12.

The conventional refrigeration cycle includes one compressor, one condenser, one capillary tube, and one evaporator. However, in recent years, various types of refrigeration cycles in which at least one of a compressor, a condenser, a capillary tube, and an evaporator is provided in plurality are being proposed.

FIG. 3 is a conceptual view illustrating an example of the refrigeration cycle.

For example, a refrigeration cycle 20 may include two condensers, two capillary tubes, and two evaporators. Referring to FIG. 3, a refrigerant condensed in the condenser 21 is introduced into one of a refrigerating compartment capillary tube 23*a* and a freezing compartment capillary tube 23*b* through a three-way valve 22.

When the three-way valve 22 is used, the refrigerant may be selectively introduced into one of the refrigerating compartment capillary tube 23*a* and the freezing compartment capillary tube 23*b* or may not be introduced into the two capillary tubes.

The refrigerant introduced into the refrigerating compartment capillary tube 23*a* is evaporated in the refrigerating compartment evaporator 14*a* to generate cold air. A refrigerating compartment blowing fan 15*a* blows the cold air generated in the evaporator 14*a*. When the three-way valve 22 is controlled, the introduction of the refrigerant into the refrigerating compartment capillary tube 23*a* may be blocked, and the refrigerant may be introduced into the freezing compartment capillary tube 23*b*. The refrigerant introduced into the freezing compartment capillary tube 23*b* is evaporated in the freezing compartment evaporator 14*b* to generate cold air. The freezing compartment blowing fan 15*b* blows the cold air generated in the evaporator 14*b*.

The refrigerant evaporated in each of the refrigerating compartment evaporator 14*a* and the freezing compartment evaporator 14*b* is compressed in a refrigerating compartment compressor 24*a* or a freezing compartment compressor 24*b* and then introduced again into the condenser 21.

According to the refrigeration cycle described with reference to FIG. 3, the cold air to be supplied to the refrigerating compartment and the cold air to be supplied to the freezing compartment may be separately generated. The refrigerator 10 described in FIG. 1 includes components for supplying the cold air generated in the refrigerating compartment evaporator 14*a* and the freezing compartment evaporator 14*b* to the refrigerating compartment and the freezing compartment. Particularly, the refrigerator 10 described in FIG. 1 may include components for selectively supplying the cold air generated in the refrigerating compartment evaporator 14*a* to the first and second refrigerating compartments 11*a* and 11*b*.

FIG. 4 is a conceptual view illustrating constituents for introducing cold air into the first and second refrigerating compartments 11*a* and 11*b* and the freezing compartment 11*c*.

As illustrated in FIGS. 3 and 4, the refrigerating compartment evaporator 14*a* for generating cold air for cooling the first and second refrigerating compartments 11*a* and 11*b* is provided at a rear side of the refrigerator body 11.

For example, the refrigerating compartment evaporator 14*a* may be disposed behind the first refrigerating compartment 11*a*. A freezing compartment evaporator (not shown) for generating cold air for cooling the freezing compartment 11*c* may be provided behind the freezing compartment 11*c*. In the drawings, for convenience of description, constituents for introducing cold air into the freezing compartment 11*c* are omitted. As described above, to cool the first and second storage chambers 11*a* and 11*b* by using the refrigerating compartment evaporator 14*a*, the refrigerator 10 includes a blowing fan 15*a* for blowing the cold air generated in the refrigerating compartment evaporator 14*a*, a multi duct 16 for supplying the blown cold air into each of the first and second refrigerating compartments 11*a* and 11*b*, and dampers 17 (17*a* and 17*b*) controlling the supply of the cold air into the first and second refrigerating compartments 11*a* and 11*b*.

Also, the first refrigerating compartment 11*a* may be partitioned into a plurality of spaces 11*a*1, 11*a*2, and 11*a*3 by the shelf 13*a*.

The freezing compartment evaporator 14*b* may be disposed at a rear side of the refrigerator body 11 and disposed behind the freezing compartment 11*c*. To cool the freezing compartment 11*c* by using the freezing compartment evaporator 14*b*, the refrigerator 10 may include a freezing compartment blowing fan 15*b* for blowing the cold air generated in the freezing compartment evaporator 14*b*, a duct (not shown) for supplying the blown cold air into the freezing compartment 11*c*, and a freezing compartment damper (not shown) controlling the supply of the cold air into the freezing compartment 11*c*.

In the refrigerator 10 described with reference to FIGS. 1 to 4, the three storage chambers are alternately cooled up to a lower limit temperature to independently control each of the three storage chambers.

However, according to the above-described control method, the cold air may not be introduced into each of the storage chambers for a predetermined time. Here, the storage chamber may increase in temperature. Also, as a temperature reduction rate between the storage chambers increases, a time for which the cold air is not introduced into the storage chamber may increase, and thus, the temperature of the storage chamber may exceed an upper limit temperature.

Also, when an error range in temperature of the storage chamber decreases, since the upper limit temperature of the storage chamber decreases, the temperature of the storage comber may exceed the upper limit temperature while the cold air is not introduced into the storage chamber.

DISCLOSURE OF THE INVENTION

Technical Problem

An object of the prevent invention is to provide a control method for a refrigerator, which prevents a temperature of a portion of storage chambers into which cold air is not introduced from excessively increasing while the plurality of storage chambers are alternately cooled.

Also, an object of the present invention is to provide a control method for a refrigerator, which prevents a temperature of the other one of storage chambers into which cold air is not introduced from excessively increasing while cold air is introduced into only one of two independent refrigerating compartments.

Also, an object of the present invention is to provide a control method for a refrigerator, which prevents a temperature of a refrigerating compartment from excessively increasing while cold air is introduced into only a freezing compartment.

Technical Solution

A method for controlling a refrigerator according to the present invention includes a first evaporator, which receives a compressed refrigerant to generate cold air for cooling a first storage chamber having a high-temperature chamber and a low-temperature chamber, which have different temperatures, a first cooling fan for supplying the cold air into the first storage chamber, a second evaporator receiving the compressed refrigerant to generate cold air for cooling a second storage chamber that is maintained at a temperature different from that of the first storage chamber, a second cooling fan for supplying the cold air into the second storage chamber, and at least one damper to selectively open one or more of a first cold-air passage through which the cold air flows to the high-temperature chamber and a second cold-air passage through which the cold air flows to the low-temperature chamber, wherein the cooling of the first storage chamber and the cooling of the second storage chamber are alternately or simultaneously performed and wherein the cooling of the high-temperature chamber and the low-temperature chamber are simultaneously or alternately performed.

Particularly, the method for controlling the refrigerator includes: driving the first cooling fan to cool the first storage chamber; adjusting a damper to allow the cold air to simultaneously flow through first and second cold-air passages; adjusting the damper to reduce the opening angle of the first cold-air passage when the temperature of the high-temperature chamber reaches a value smaller than or equal to a second reference temperature for the high-temperature chamber; adjusting a damper to reduce the opening angle of the second cold-air passage, when the temperature of the low-temperature chamber reaches a value smaller than or equal to a second reference temperature for the low-temperature chamber; and driving the second cooling fan to cool the second storage chamber.

In the present invention, after the temperature of the high-temperature chamber reaches the value smaller than or equal to the second reference temperature for the high-temperature chamber, when a predetermined time passes or the sensed temperature of the high-temperature chamber reaches a first set temperature between a first reference temperature and the second reference temperature for the high-temperature chamber, the damper may be adjusted to increase the opening angle of the first cold-air passage.

After the driving of the second cooling fan starts, when a predetermined time elapses, or the sensed temperature of the high-temperature chamber reaches a second set temperature between the first reference temperature and the second reference temperature for the high-temperature chamber, the method may further include a step increasing an output of the first cooling fan increases and adjusting the damper to increase opening angles of one or more of the first and second cold-air passages.

The one or more dampers may include: a first damper opening and closing the first cold-air passage; and a second damper opening and closing the second cold-air passage, wherein, in the adjusting of the damper to increase the opening angle of the one or more of the first and second cold-air passages, each of the first damper and the second damper may be opened in a closed state.

In the step of adjusting the damper to increase one or more of the first and second cold-air passages, the opening angles of one or more of the first and second cold-air passages may increase or decrease at a predetermined period.

After the damper is adjusted to increase the opening angles of one or more of the first and second cold-air passages, when the temperature of the second storage chamber reaches a value that is equal to or below a third reference temperature for the second storage chamber, the output of each of the first and second cooling fans may decrease.

After the damper is adjusted to increase the opening angles of one or more of the first and second cold-air passages, when the temperature of the first evaporator reaches a set value before the temperature of the second storage chamber reaches the value that is equal to or below the third reference temperature for the second storage chamber, the damper may be adjusted to decrease the opening angles of one or more of the first and second cold-air passages.

After the damper is adjusted to increase the opening angle of the first cold-air passage, when the predetermined time elapses, or the sensed temperature of the high-temperature chamber reaches a third set temperature that is previously set between the first set temperature and the second reference temperature for the high-temperature chamber, the damper may be adjusted to decrease the opening angle of the first cold-air passage.

The one or more dampers may include: a first damper opening and closing the first cold-air passage; and a second damper opening and closing the second cold-air passage. In the step of adjusting the damper so that the temperature of the high-temperature chamber reaches the value that is equal to or below the second reference temperature for the high-temperature chamber to decrease the opening angle of the first cold-air passage, the opened state of the second cold-air passage may be maintained by the second damper.

In the step of adjusting the damper so that the temperature of the high-temperature chamber reaches the value that is equal to or below the second reference temperature for the high-temperature chamber to decrease the opening angle of the first cold-air passage, the first damper may be closed.

In the step of adjusting the damper to increase the opening angle of the first cold-air passage after the temperature of the high-temperature chamber reaches the value that is equal to or below the second reference temperature for the high-temperature chamber, the closed first damper may be opened.

In the step of adjusting the damper so that the temperature of the low-temperature chamber reaches the value that is equal to or below the second reference temperature for the low-temperature chamber to decrease the opening angle of the second cold-air passage, each of the first damper and the second damper may be closed.

A refrigerator to which a control method of the present invention according to another aspect is applied includes: a refrigerating compartment evaporator generating cold air to be introduced into first and second refrigerating compartments; first and second dampers that are opened or closed to allow or block the introduction of the cold air into each of the first and second refrigerating compartments; a first temperature sensor measuring a temperature of the first refrigerating compartment; and a control unit controlling the opening and closing operation of the first and second dampers.

The control unit may additionally open the first damper so that the cold air is introduced into the first refrigerating compartment when the temperature of the first refrigerating compartment reaches a first reference temperature in a state in which only the second damper is opened to allow the cold air to be introduced into the second refrigerating compartment while the refrigerant is supplied to the refrigerating compartment evaporator.

The control unit may additionally open the second damper so that the cold air generated in the refrigerating compartment evaporator is introduced into only the second refrigerating compartment from a time point at which the first refrigerating compartment is cooled at a first target temperature to a time point at which the first refrigerating compartment reaches the first reference temperature while the refrigerant is supplied to the refrigerating compartment evaporator.

The control unit may maintain the opened state of the first and second dampers until the second refrigerating compartment is cooled at a second target temperature after the first damper is additionally opened to allow the cold air to be introduced into the first refrigerating compartment.

The control unit may maintain the opened state of the first and second dampers until the second refrigerating compartment is cooled at a second target temperature after the first damper is additionally opened to allow the cold air to be introduced into the first refrigerating compartment.

The refrigerator may further include: a freezing compartment; a freezing compartment evaporator generating cold air to be introduced into the freezing compartment; and a valve configured to selectively supply the refrigerant into the refrigerating compartment evaporator or the freezing compartment evaporator, wherein the control unit may open the first damper so that the cold air remaining in the refrigerating compartment evaporator is introduced into the first refrigerating compartment when the first refrigerating compartment reaches a second reference temperature while the refrigerant is supplied to the freezing compartment evaporator so that the cold air is introduced into only the freezing compartment.

The control unit may repeatedly open and close the first damper at a preset time interval from a time point at which the first refrigerating compartment reaches the second reference temperature while the cold air is introduced into the freezing compartment.

The control unit may repeatedly open and close the first damper until the freezing compartment is cooled at a third target temperature.

The control unit may open the second damper together with the first damper so that a portion of the cold air remaining in the refrigerating compartment evaporator is introduced into the second refrigerating compartment when the first refrigerating compartment reaches the second reference temperature while the refrigerant is supplied into the freezing compartment evaporator so that the cold air is introduced into only the freezing compartment.

A refrigerator according to further another aspect includes: a refrigerating compartment evaporator generating cold air to be introduced into the refrigerating compartment; a freezing compartment evaporator generating cold air to be introduced into the freezing compartment; a damper that is opened and closed to allow or block the introduction of the cold air into the refrigerating compartment evaporator; a valve configured to selectively supply the refrigerant into the refrigerating compartment evaporator or the freezing compartment evaporator; a temperature sensor measuring a temperature of the refrigerating compartment; and a control unit controlling operations of the damper and the valve, wherein the control unit may open the damper so that the cold air remaining in the refrigerating compartment evaporator is introduced into the refrigerating compartment when the temperature of the refrigerating compartment reaches a reference temperature in a state in which the refrigerant is supplied into the freezing compartment evaporator so that the cold air is introduced into only the freezing compartment.

A refrigerator according to further another aspect includes: a refrigerating compartment evaporator generating cold air to be introduced into first and second refrigerating compartments; a freezing compartment evaporator generating cold air to be introduced into the freezing compartment; a valve configured to selectively supply a refrigerant into the refrigerating compartment evaporator or the freezing compartment evaporator; a damper that is opened and closed to allow or block the introduction of the cold air into the first refrigerating compartment; a temperature sensor measuring a temperature of the first refrigerating compartment; and a control unit controlling the opening and closing of the damper and controlling the valve so that the cold air is generated from one of the refrigerating compartment evaporator and the freezing compartment evaporator, wherein the control unit may open the damper so that the cold air is introduced into the first refrigerating compartment when the first refrigerating compartment reaches a reference temperature while the cold air is introduced into only one of the second refrigerating compartment and the freezing compartment.

Advantageous Effects

In the present invention, when the temperature of the first refrigerating compartment reaches the first set temperature while the cold air is introduced into only the second refrigerating compartment, the cold air may be additionally introduced into the first refrigerating compartment. Thus, even if the temperature reduction rate between the first and second refrigerating compartments is large, the temperature of the first refrigerating compartment may be prevented from excessively increasing while the second refrigerating compartment is concentratedly cooled.

In the present invention, the start time point of the circulation operation may be determined according to the temperature of the first refrigerating compartment. Thus, the present invention may prevent the first and second refrigerating compartments from being overcooled or excessively increasing in temperature through the circulation operation. Here, the circulation operation may represent that the cold air remaining in the refrigerating compartment evaporator is introduced into the first and second refrigerating compartments at the predetermined period while the cold air is introduced into only the freezing compartment.

In summary, while the other storage chamber in addition to the first refrigerating compartment is concentratedly cooled, since the cold air is introduced into the first refrigerating compartment according to the temperature of the first refrigerating compartment, the variation in temperature of the first refrigerating compartment may be reduced. Thus, according to the present invention, the error range of the temperature of the storage chamber may be reduced.

In addition, according to the present invention, when the alternate operation is performed at a predetermined period, since the cold air is flexibly introduced according to the temperature of the storage chamber, the temperature of a portion of the storage chambers may be prevented from excessively increasing during the alternate operation. Therefore, the refrigerator according to the present invention may stably perform the alternate operation.

MODE FOR CARRYING OUT THE INVENTION

Hereinafter, a refrigerator related to the present invention will be described in more detail with reference to the accompanying drawings.

The terms of a singular form may include plural forms unless referred to the contrary.

In description of embodiments disclosed in this specification, detailed descriptions related to well-known functions or configurations will be ruled out in order not to unnecessarily obscure subject matters of the present invention.

However, this does not limit the present invention within specific embodiments and it should be understood that the present invention covers all the modifications, equivalents, and replacements within the idea and technical scope of the present invention.

In a refrigerator 10 described with reference to FIGS. 1 to 4, three storage chambers are independently controlled in temperature. Prior to description of the refrigerator according to the present invention, a method of controlling a temperature of the conventional refrigerator will be described in detail.

In the present invention, the temperature of a second refrigerating compartment is not limited to a temperature above zero, but maintained to a temperature below zero. Thus, the temperature of the second refrigerating compartment may be maintained between a temperature of a first refrigerating compartment and a temperature of the freezing compartment.

Also, in the present invention, since the first refrigerating compartment is maintained at a temperature greater than that of the second refrigerating compartment, the first refrigerating compartment may be called a high-temperature chamber, and the second refrigerating compartment may be called a low-temperature chamber.

Figure 5:
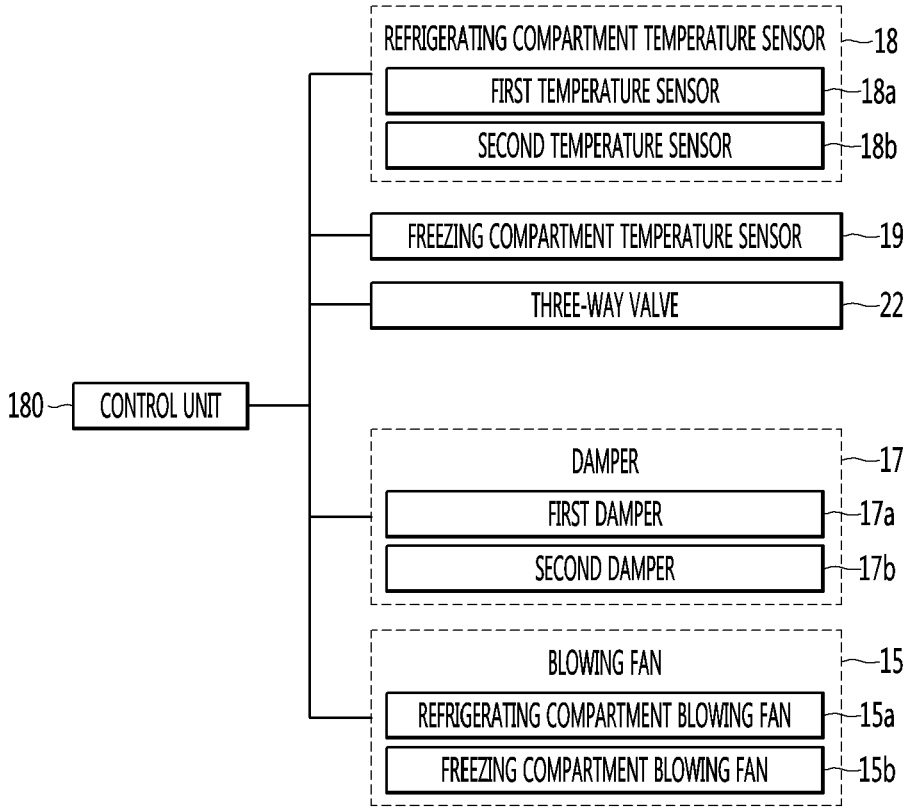
FIG. 5 is a block diagram illustrating a component for controlling a temperature of a refrigerator storage chamber.

FIG. 5 is a block diagram illustrating a component for controlling a temperature of a refrigerator storage chamber.

Referring to FIG. 5, a refrigerator 10 may include a control unit 180.

The control unit 180 may control a three-way valve 22, a blowing fan 15, and a damper 17 to control a temperature of each of storage chambers.

The control unit 180 may controls the three-way valves to selectively supply a refrigerator to one of a refrigerating compartment evaporator 14*a* (or a first evaporator) or a freezing compartment evaporator 14*b* (or a second evaporator) or block the supply of the refrigerator to the two evaporators. That is, the control unit 180 controls the three-way valve 22 to allow the three-way valve 22 to be in a first state in which the three-way valve 22 does not supply the cold air to the two evaporators, a second state in which the refrigerant is supplied to only the refrigerating compartment evaporator 14*a*, and a third state in which the refrigerant is supplied to only the freezing compartment evaporator 14*b*. Hereinafter, a state of the three-way valve 22 is represented by the first to third states described above.

The control unit 180 controls the blowing fan 15 and the damper 17 to control an introduction of the cold air into the first and second refrigerating compartment 11*a* and 11*b*. Specifically, the control unit 180 drives the refrigerating compartment blowing fan 15*a* (or a first cooling fan) in the second state, opens the first and second dampers 17*a* and 17*b* to introduce the cold air into each of the first and second refrigerating compartments 11*a* and 11*b*. While the refrigerating compartment blowing fan 15*a* is being driven in the second state, the control unit 180 may open only one of the first and second dampers 17*a* and 17*b* to selectively introduce the cold air into one of the first and second refrigerating compartments 11*a* And 11*b*. As described above, the control unit 180 may control the introduction of the cold air into the first and second refrigerating compartments 11*a* and 11*b* through communication between the refrigerating compartment blowing fan 15*a* and the first and second dampers 17*a* and 17*b*.

However, the present invention is not limited thereto. The control unit 180 may drive the refrigerating compartment blowing fan 15*a* in the first and third states and open the first and second dampers 17*a* and 17*b*, i.e., even when the refrigerant is not supplied to the refrigerating compartment evaporator 14*a*. Thus, the cold air remaining in the refrigerating compartment evaporator 14*a* may be introduced into the first and second refrigerating compartments 11*a* and 11*b*. That is, the control unit 180 drives the refrigerating compartment blowing fan 15*a* and opens the first and second dampers 17*a* and 17*b* regardless of whether the refrigerant is supplied to the refrigerating compartment evaporator 14*a*. This will be described later. In the present invention, the first damper 17*a* selectively opens a first cold-air passage for allowing the cold air to flow into the first refrigerating compartment 11*a*, and the second damper 17*b* selectively open a second cold-air passage for allowing the cold air to flow into the second refrigerating compartment 11*b*.

Alternatively, the damper may be changed in structure so that one damper opens or closes the first and second cold-air passages at the same time or opens only one cold-air passage. Also, an opening angle of each of the cold-air passages may be adjusted in the state in which one damper opens the cold-air passages at the same time.

The control unit 180 controls the blowing fan 15 to introduce the cold air into the freezing compartment 11*c*. In this specification, for convenience of explanation, although the introduction of the cold air into the freezing compartment 11*c* is controlled by only the freezing compartment blowing fan 15*b* (or the second cooling fan), the refrigerator 10 may include a third damper for allowing or blocking the introduction of the cold air into the freezing compartment 11*c*. The third damper communicates with the freezing compartment blowing fan 15*b*. That is, whether the third damper is opened or closed may be determined according to whether the freezing compartment blowing fan 15*b* is driven.

For example, when the freezing compartment blowing fan 15*b* is in operation, the third damper is in the opened state, and when the freezing compartment blowing fan 15*b* is not in operation, the third damper is in the closed state. Thus, whether the third damper is opened or closed may be predicted by explaining only whether the freezing compartment blowing fan 15*b* is driven. Hereinafter, whether the cold air is introduced into the freezing compartment 11*c* will be explained only by whether the freezing compartment blowing fan 15*b* is driven.

The control unit 180 drives the freezing compartment blowing fan 15*b* in the third state to allow the cold air generated in the freezing compartment evaporator 14*b* to flow into the freezing compartment 11*c*. The control unit 180 controls the blowing fan 14 so that the cold air remaining in the freezing compartment evaporator 14*b* is introduced into the freezing compartment 11*c* in the first and second states, i.e., even when the refrigerant is not supplied to the freezing compartment evaporator 14*b*.

The control unit 180 controls the introduction of the cold air into each of the three storage chambers in the manner described above so that the three storage chambers are successively cooled up to a preset lower limit temperature.

The control unit 180 receives a temperature value from a refrigerating compartment temperature sensor 18 disposed in the refrigerating compartment and controls a temperature of the storage chamber on the basis of the temperature value.

Here, when the refrigerating compartment is constituted by first and second refrigerating compartments 11*a* and 11*b*, the refrigerating compartment temperature sensor 18 includes a first temperature sensor 18*a* disposed in the first refrigerating compartment 11*a* and a second refrigerating compartment 18*b* disposed in the second temperature sensor 11*b*.

Each of the first and second temperature sensors 18*a* and 18*b* may include a plurality of sensors. A plurality of temperature sensors may be disposed in each of the first and second refrigerating compartments 11*a* and 11*b*. In this case, a measured temperature may vary according to a position at which the sensor is disposed. When the temperature sensors disposed in the first and second refrigerating compartment 11*a* and 11*b* are provided in plurality, the control unit 180 may receive temperature values from the plurality of temperature sensors to control a temperature of the storage chamber on the basis of a mean value of the received temperature values.

The control unit 180 receives a temperature value from a freezing compartment temperature sensor 19 disposed in the freezing compartment 11*c* and controls a temperature of the storage chamber on the basis of the temperature value. Here, the freezing compartment temperature sensor 19 may include a plurality of temperature sensors. In this case, the control unit 180 may receive the temperature value from each of the plurality of temperature sensors and may control the temperature of the storage chamber on the basis of a mean value of the received temperature values.

Hereinafter, with reference to the accompanying drawings, a control method in which the first and second refrigerating compartments 11*a* and 11*b* and the freezing compartment 11*c* are successively cooled up to lower limit temperatures under the control of the control unit 180, respectively, will be described according to a time flow.

Figure 1:
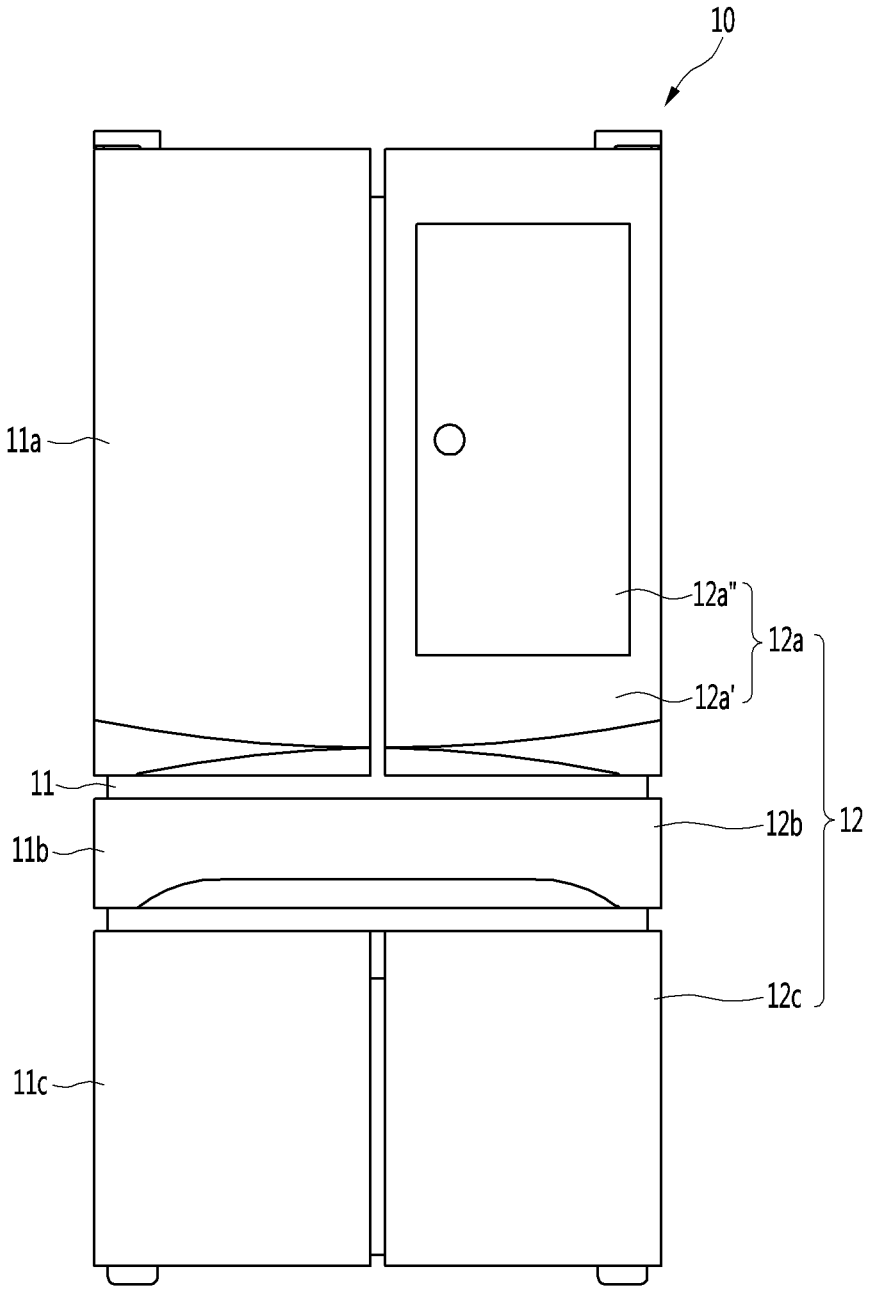
FIG. 1 is a front view illustrating an example of a refrigerator.
Figure 2:
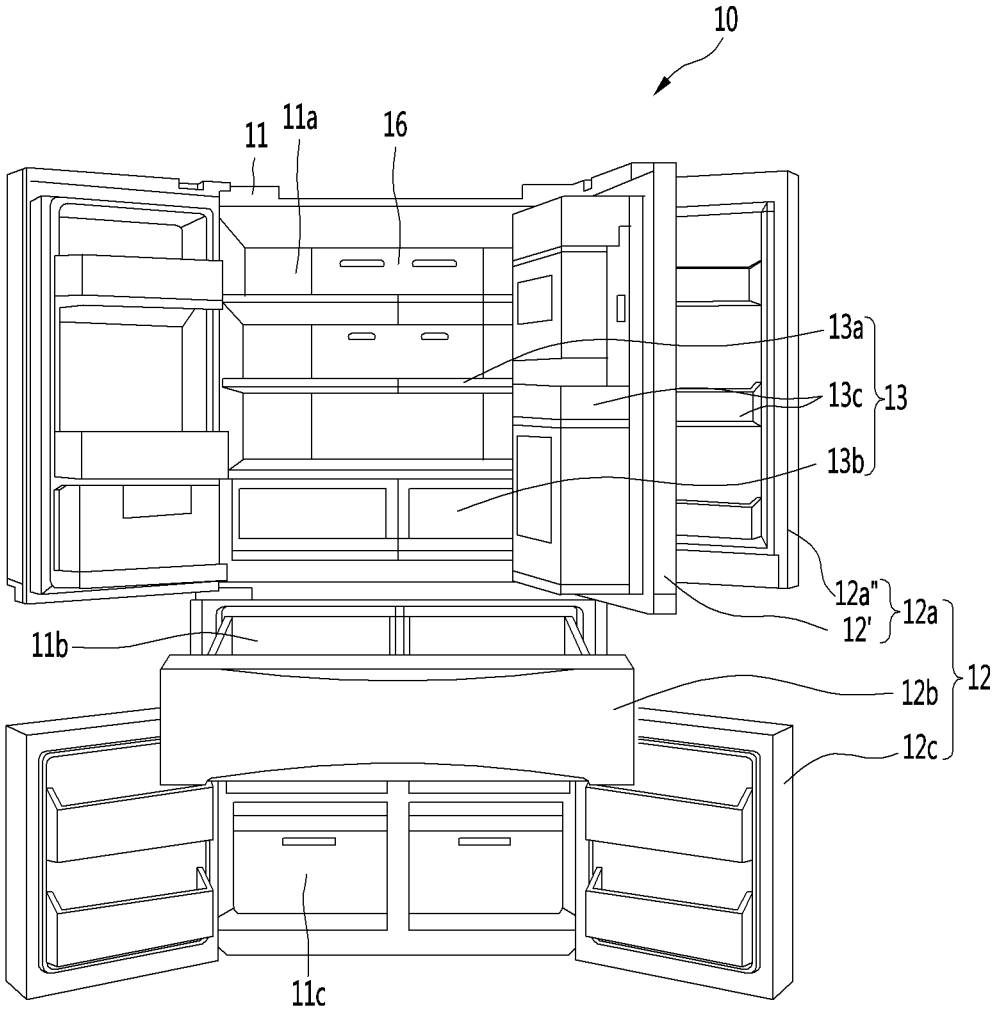
FIG. 2 is a conceptual view illustrating a state in which a door of the refrigerator of FIG. 1 is opened.
Figure 3:
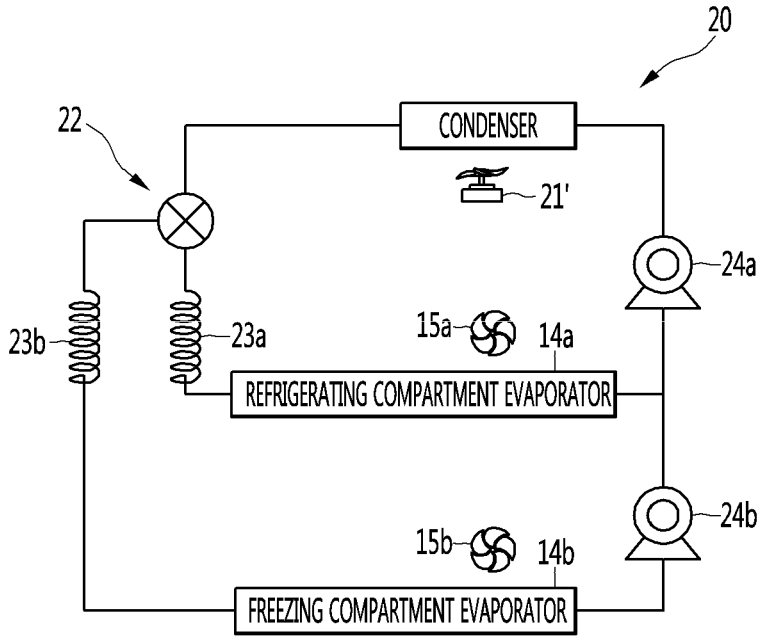
FIG. 3 is a conceptual view illustrating an example of a refrigeration cycle.
Figure 4:
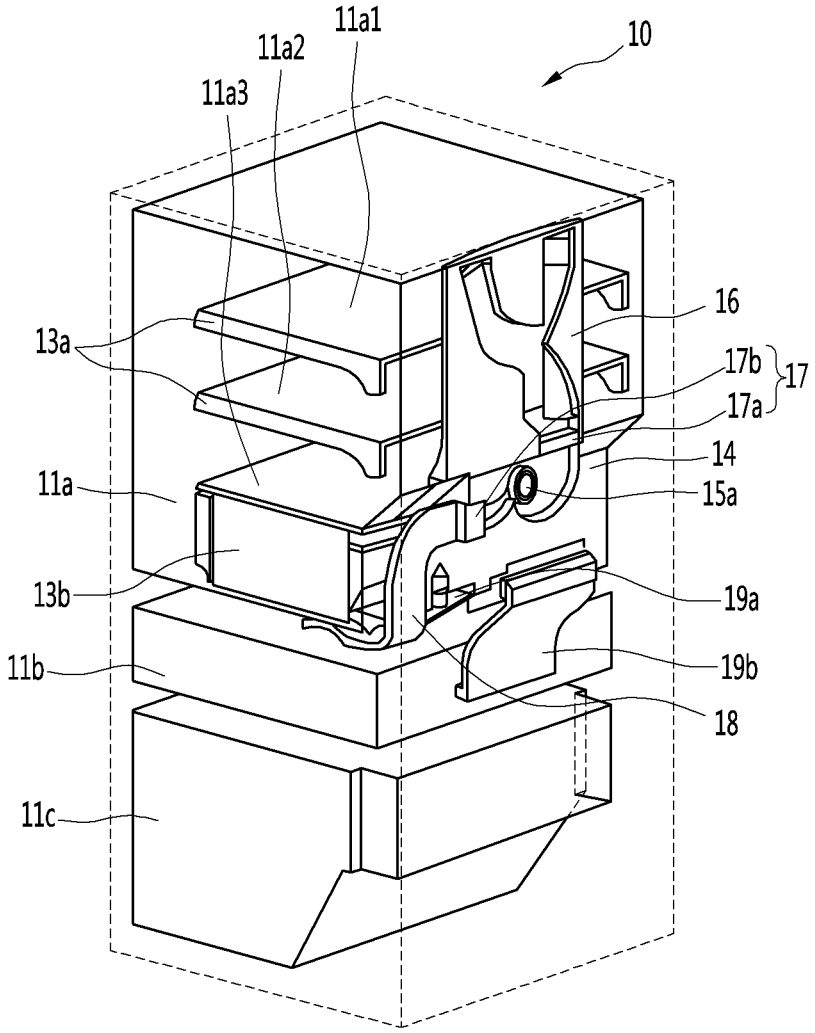
FIG. 4 is a conceptual view illustrating constituents for introducing cold air into first and second refrigerating compartments 11*a* and 11*b* and a freezing compartment 11*c*.

The control method of the present invention may be applied not only to a refrigerator that forms a cooling cycle by using two compressors and two evaporators as shown in FIG. 3, but also to a refrigerator that form a cooling cycle by using a single compressor and two evaporators (a refrigerating compartment evaporator and a freezing compartment evaporator).

When one compressor is used, the refrigerant compressed by the compressor may flow to one of the two evaporators (the refrigerating compartment evaporator and freezing compartment evaporator) by adjusting the refrigerant passage by a switching valve.

Figure 6:
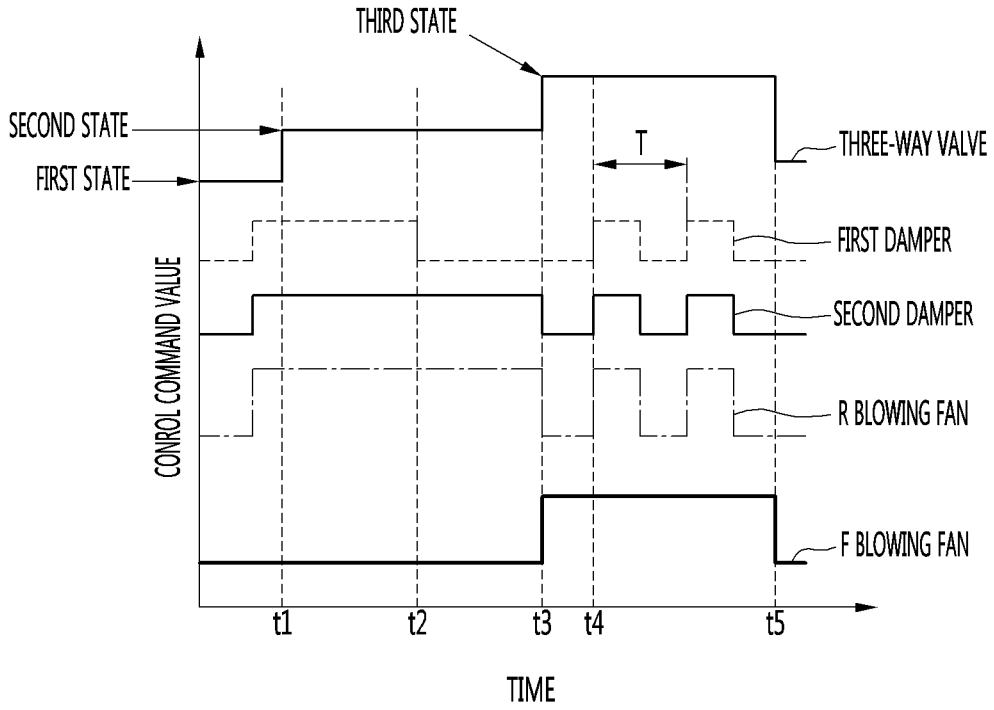
FIG. 6 is a control flowchart of a refrigerator according to a time.

FIG. 6 is a control flowchart of the refrigerator according to a time.

The control unit 180 supplies the cold air to the storage chamber to cool the storage chamber up to a lower limit temperature and blocks the supply of the cold air for a predetermined time. Thereafter, the control unit 180 concentratedly supplies the cold air to the other storage chamber to cool the other storage chamber up to the lower limit temperature.

The temperature of the storage chamber into which the cold air is not supplied after reaching the lower limit temperature increases as a time elapses. The refrigerator 10 supplies the cold air again before the storage chamber exceeds an upper limit temperature (or the first reference temperature) to maintain the storage chamber at a temperature between the lower limit temperature (or a second reference temperature) and the upper limit temperature.

In this specification, the lower limit temperature and the upper limit temperature of the storage chamber may be understood as the minimum and maximum temperatures allowed in each storage chamber. The lower and upper limit temperatures may be automatically set by the temperature value of the storage chamber, which is set by a user. For example, when the user sets the temperature of the first refrigerating compartment 11*a* to 3° C., the lower and upper limit temperatures may be set based on an error range with respect to the set temperature. When the error range is set to ±10%, the lower and upper limit temperatures are set at temperatures of 2.7° C. and 3.3° C., respectively.

Alternatively, the error range may be set not to the set temperature but to the temperature value itself. For example, the user may set the temperature of the first refrigerating compartment 11*a* to 3° C., and the error range may be set to ±0.5° C. In this case, the lower and upper limit temperatures are set to 2.5° C. and 3.5° C., respectively.

The lower and upper limit temperatures may be set by the user. That is, the user may set a temperature range of the storage chamber. The temperature range may be a temperature set at the factory.

The lower and upper limit temperatures set in each storage chamber may be different from each other.

Thus, in the present specification, the lower and upper limit temperatures respectively corresponding to the first and second refrigerating compartments 11*a* and 11*b* and the freezing compartment 11*c* are represented by "first", "second", and "third" ordinal numbers. In addition to the above-described expression, the lower and upper limit temperatures of each storage chamber may be expressed by the lower limit temperature of the first refrigerating compartment 11*a*, the upper limit temperature of the freezing compartment 11*c*, and the like. Also, the expression of the lower limit temperature may be replaced by a target temperature.

Referring to FIG. 6, the control unit 180 controls each of the three-way valve 22, the first damper 17*a*, the second damper 17*b*, the refrigerating compartment blowing fan 15*a* (an R blowing fan), and the freezing compartment blowing fan 15*b* (an F blowing fan) to transmit a control signal to each of the components. The components differ in operating state according to a value of the received control signal. Here, a signal value for determining an operation state of each of the components is referred to as a control command value.

The control command value may have two or three different values for each component. For example, there are two control command values for each of the first damper 17*a*, the second damper 17*b*, the refrigerating compartment blowing fan 15*a* (the R blowing fan), and the freezing compartment blowing fan 15*b* (the F blowing fan).

Particularly, there are "High" and "Low" signals. When the damper 17 or the blowing fan 15 receives the high signal, the damper 17 is in the opened state, and the blowing fan 15 is in the driving. On the other hand, when the damper 17 or the blowing fan 15 receives the Low signal, the damper 17 is in the closed state, and the blowing fan 15 is not driven.

For another example, there are three control command values for the three-way valve 22. The three-way valve 22 is in the first to third states in response to the receiving of first to third signals different from each other.

Explaining FIG. 6 according to the time flow, the control unit 180 transmits a second signal to the three-way valve 22 at a time t1 so that each of the first and second refrigerating compartments 11*a* and 11*b* reaches a target temperature. Thus, the cold air is generated in the refrigerating compartment evaporator 14*a*.

The control unit 180 transmits the High signal to each of the first and second dampers 17*a* and 17*b* and the refrigerating compartment blowing fan 15*a* just before the three-way valve 22 is switched to the second state to open the two dampers and drive the refrigerating compartment blowing fan 15*a*.

Thereafter, the control unit 180 maintains the signal transmitted to each of the first and second dampers 17*a* and 17*b* and the refrigerating compartment blowing fan 15*a* as the High signal until the first refrigerating compartment 11*a* is cooled to the first target temperature. Thus, the cold air generated in the refrigerating compartment evaporator 14*a* flows into each of the first and second refrigerating compartments 11*a* and 11*b*.

At a time t2, when the temperature of the first refrigerating compartment 11*a* reaches the first target temperature, the control unit 180 changes the signal transmitted to the first damper 17*a* to the Low signal. The control unit 180 maintains the signal transmitted to the three-way valve 22 as the second signal and maintains the signal transmitted to each of the second damper 17*b* and the refrigerating compartment blowing fan 15*a* as the High signal. Thus, only the first damper 17*a* of the first and second dampers 17*a* and 17*b* that are in the opened state is closed to introduce the cold air generated in the refrigerating compartment evaporator 14*a* into only the second refrigerating compartment 11*b*. From this time, the temperature of the first refrigerating compartment 11*a* starts to increase, and the temperature of the second refrigerating compartment 11*b* continuously decreases.

At a time t3, when the temperature of the second refrigerating compartment 11*b* reaches the second target temperature, the control unit 180 changes the signal transmitted to the three-way valve 22 into the third signal and changes the signal transmitted to the second damper 17*b* and the refrigerating compartment blowing fan 15*a* into the Low signal.

The control unit 180 changes the signal transmitted to the freezing compartment blowing fan 15*b* into the High signal. Thus, the supply of the cold air into the refrigerating compartment evaporator 14*a* is blocked, and the supply of the cold air into the freezing compartment evaporator 14*b* starts. Also, the second damper 17*b* is closed, and thus, all the first and second dampers 17*a* and 17*b* are in the closed state. At the time t2, when the temperature of the second refrigerating compartment 11*b* reaches the second target temperature, an opening angle to the second cold-air passage may be reduced by the second damper 17*b*. In this case, the second damper 17*b* may be opened while the freezing compartment 11*c* is cooled, and the opening angle to the second cold-air passage may be minimally maintained.

Also, the driving of the refrigerating compartment blowing fan 15*a* is stopped, and the driving of the freezing compartment blowing fan 15*b* starts.

From the time t3, the introduction of the cold air into the two refrigerating compartments may be stopped, and the introduction of the cold air into the freezing compartment may start. Thereafter, to prevent each of the two refrigerating compartments from exceeding the upper limit temperature, the control unit 180 starts a circulation operation with respect to the two refrigerating compartments when a preset time elapses from the time t3.

The circulation operation using the signal transmitted to the first and second dampers 17*a* and 17*b* and the refrigerating compartment blowing fan 15*a* after a time t4 in FIG. 6 will be described.

Particularly, at the time t4, the control unit 180 changes the signal transmitted to the first and second dampers 17*a* and 17*b* and the refrigerating compartment blowing fan 15*a* into the High signal while the signal transmitted to the three-way valve 22 is maintained to the third signal.

Thus, the first and second dampers 17*a* and 17*b* are opened, and the driving of the refrigerating compartment blowing fan 15*a* starts. Here, although the cold air is not generated in the refrigerating compartment evaporator 14*a*, the cold air remaining in the refrigerating compartment evaporator 14*a* is introduced into each of the first and second refrigerating compartments 11*a* and 11*b*.

The control unit 180 changes the signal transmitted to the first and second dampers 17*a* and 17*b* and the refrigerating compartment blowing fan 15*a* from the Low signal to the High signal or from the High signal to the Low signal at a predetermined period T from the time t4. Thus, the first and second dampers 17*a* and 17*b* are repeatedly opened and closed at a predetermined period T, and the driving and the driving stop of the refrigerating compartment blowing fan 15*a* are repeated. Here, the cold air remaining in the refrigerating compartment evaporator 14*a* is periodically introduced into the first and second refrigerating compartments 11*a* and 11*b*. That is, in this specification, the circulation operation represents an operation for periodically introducing the cold air remaining in the refrigerating compartment evaporator 14*a* into the first and second refrigerating compartments 11*a* and 11*b*.

As described above, the control unit 180 starts the circulation operation after a predetermined time elaspes from the time point at which the introduction of the cold air into the freezing compartment starts to prevent each of the first and second refrigerating compartments 11*a* and 11*b* from exceeding the upper limit temperature.

Thereafter, when the freezing compartment is cooled (t5) up to a third target temperature (or a third reference temperature), the control unit 180 changes the signal transmitted to the three-way valve 22 into the first signal to transmit the Low signal to each of the first and second dampers 17*a* and 17*b*, the refrigerating compartment blowing fan 15*a*, and the freezing compartment blowing fan 15*b*. Thus, the cold air is not generated in all the two evaporators, and the cold air of the freezing compartment is not introduced into all the storage chambers.

In this specification, the above-described driving method of the refrigerator is referred to as an alternate operation. That is, the refrigerator described in FIG. 6 allows the three storage chambers to alternately reach the target temperature through the alternate operation, and the alternate operation is periodically repeated so that the temperature of each of the three storage chambers is within the preset temperature range.

However, two problems may occur in the alternate operation described above. Hereinafter, the two problems that may occur in the alternate operation will be described with reference to FIGS. 7 and 8. For reference, times t1 to t4 of FIGS. 7 and 8 are the same those of FIG. 6.

Figure 7:
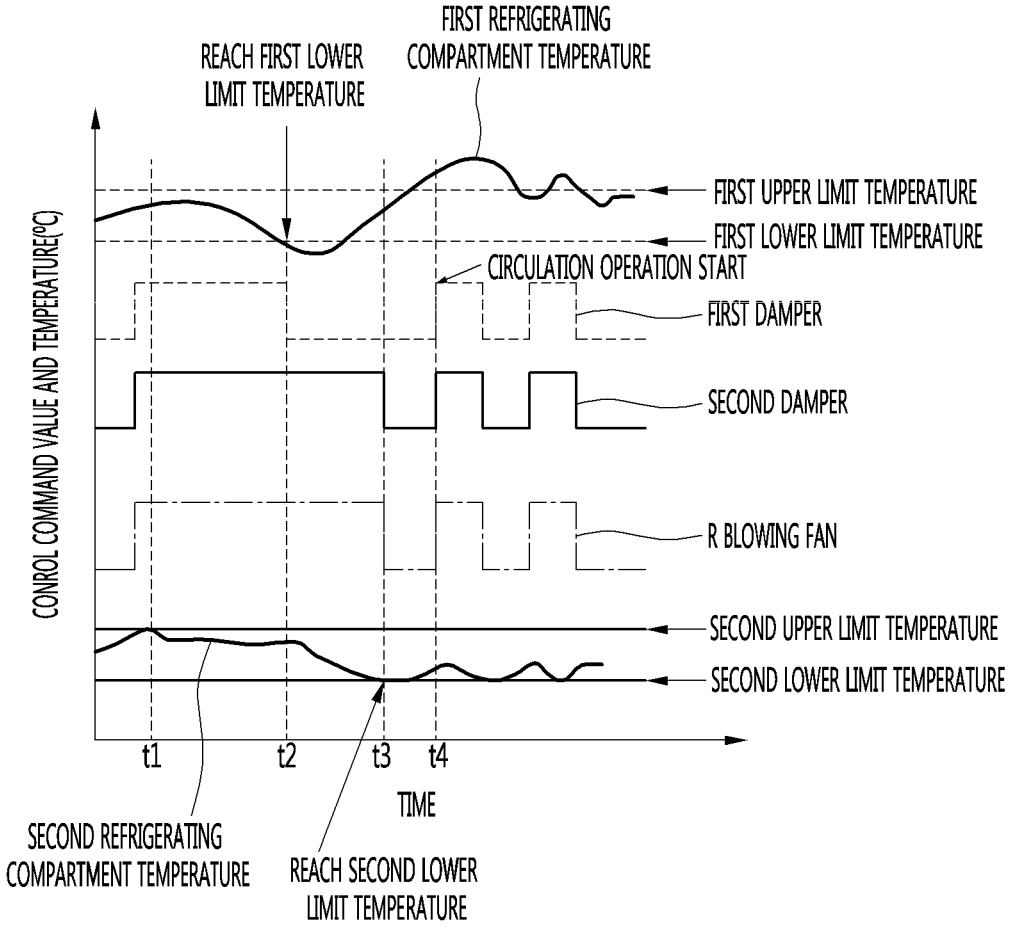
FIG. 7 is a graph illustrating a control flow of FIG. 6 and a variation in temperature of a refrigerating compartment.
Figure 8:
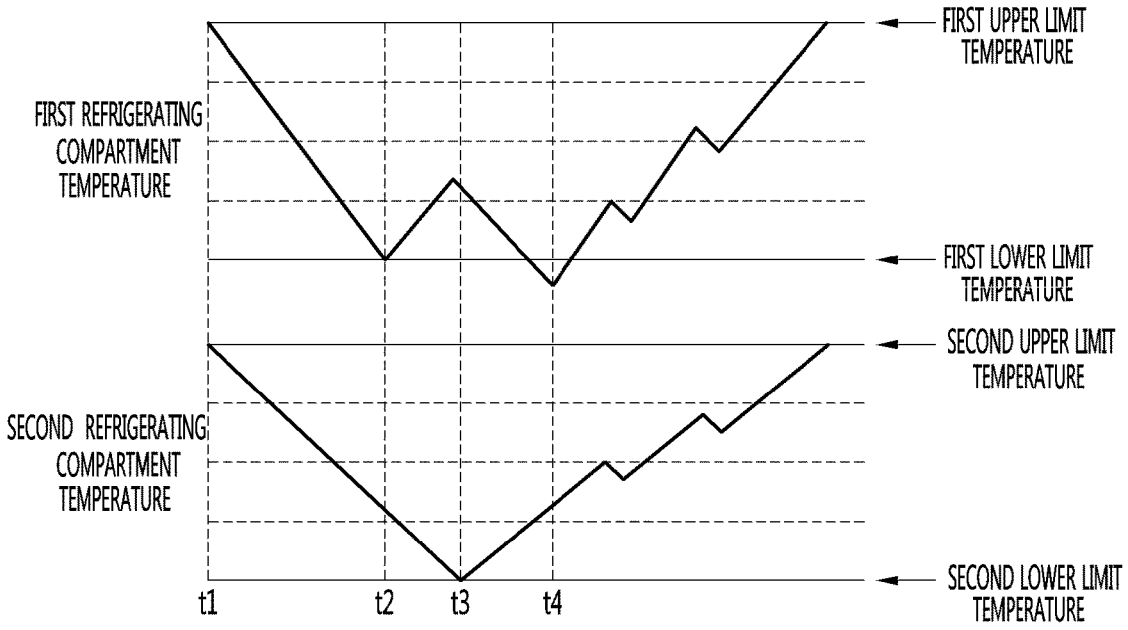
FIG. 8 is a conceptual view illustrating operation states of components and a variation in temperature of the refrigerating compartment according to the control of FIG. 6.

FIG. 7 is a graph illustrating a control flow of FIG. 6 and a variation in temperature of a refrigerating compartment, and FIG. 8 is a conceptual view illustrating operation states of components and a variation in temperature of the refrigerating compartment according to the control of FIG. 6.

First, a problem may occur in a period from the time t2 to the time t3 of FIG. 7. In the period from the time t2 to the time t3, while the refrigerant is supplied to the refrigerating compartment evaporator 14*a*, the first damper 17*a* is closed, and the second damper 17*b* is opened. That is, the period from the time t2 to the time t3 is in a state in which the refrigerant is supplied to only the second refrigerating compartment 11*b*.

After the first refrigerating compartment 11*a* reaches the first lower limit temperature at the time t2, the cold air is introduced into the second refrigerating compartment 11*b*, and thus, the temperature of the first refrigerating compartment 11*a* continuously increases. That is, since the target temperature of the second storage chamber is less than the target temperature of the first storage chamber, the second damper 17*b* is opened, and thus, the first refrigerating compartment 11*b* increases in temperature until the second refrigerating compartment 11*b* reaches the second lower limit temperature.

When the period from the time t2 to the time t3 increases, the temperature of the first refrigerating compartment 11*a* may excessively increase in the period from the time t2 to the time t3.

Furthermore, when the period from the time t2 to the time t3 exceeds a predetermined range, the temperature of the first refrigerating compartment 11*a* may exceed the first upper limit temperature in the period from the time t2 to the time t3. Here, a factor for increasing the period from the time t2 to the time t3 is the temperature of the second refrigerating compartment 11*b* when entering to the time t2.

Specifically, when the first refrigerating compartment 11*a* reaches the first lower limit temperature (t2), the more the period from the time t2 to the time t3 increases, the more a difference between the temperature of the second refrigerating compartment 11*b* and the second lower limit temperature increases. Here, when the first refrigerating compartment 11*a* reaches the first lower limit temperature (t2), the temperature of the second refrigerating compartment 11*b* may be determined according to the difference in temperature reduction rate between the first and second refrigerating compartments 11*a* and 11*b*.

For example, as the temperature reduction rate of the first refrigerating compartment 11*a* is larger than that of the second refrigerating compartment 11*b*, and the difference in temperature reduction rate between the first and second refrigerating compartments 11*a* and 11*b* is greater, when the first refrigerating compartment 11*a* reaches the first lower limit temperature (t2), the temperature of the second refrigerating compartment 11*b* is high. When the refrigerating compartment evaporator 14*a* is disposed on the rear surface of the first refrigerating compartment 11*a*, the first refrigerating compartment 11*a* is cooled faster than the second refrigerating compartment 11*b* due to the contact with the refrigerating compartment evaporator 14*a*. In this case, the temperature reduction rate between the first and second refrigerating compartments 11*a* and 11*b* may vary greatly.

As described above, the temperature of the first refrigerating compartment 11*a* may excessively increase in the period from the time t2 to the time t3 due to the factor in which the period from the time t2 to the time t3 increases.

Furthermore, when the error range of the storage chamber temperature set by the user is reduced, the temperature difference between the first lower limit temperature and the first upper limit temperature is reduced. In this case, since the time taken to allow the first refrigerating compartment 11*a* to reach the first upper limit temperature after being cooled to the first lower limit temperature is reduced, the allowable period from the time t2 to the time t3 is reduced. When the error range of the storage chamber temperature set by the user is reduced to a predetermined level or less, the temperature of the first refrigerating compartment 11*a* exceeds the first upper limit temperature in the period from the time t2 to the time t3.

Due to the above-described problems, it is difficult to continuously maintain the alternate operation, and it is restricted to reduce the error range of the storage chamber temperature to a predetermined level or less.

Second, a problem may occur in a period from the time t3 to the time t4 of FIG. 7. In the period from the time t3 to the time t4, the cold air is generated in the freezing compartment evaporator 14*b*, and the cold air is introduced into only the freezing compartment 11*c*. When a predetermine time elapses from the time t3, the circulation operation starts to cool the first and second refrigerating compartments 11*a* and 11*b*. Here, when the circulation operation starts too soon, the second refrigerating compartment 11*b* is cooled to a temperature that is below the second lower limit temperature, and when the circulation operation starts too late, the temperature of the first refrigerating compartment 11*a* exceeds the first upper limit temperature. As described above, there is a problem that it is difficult to accurately set the start time point of the circulation operation.

Referring to FIG. 8, to solve the problem occurring in the period from the time t2 to the time t3, a method of additionally opening the first damper 17*a* in the period from the t3 to the t4 may be considered.

The cold air remaining in the refrigerating compartment evaporator 14*a* may be introduced into the first refrigerating compartment 11*a* in the period from the time t3 to the time t4 to prevent the first refrigerating compartment 11*a* from reaching the first upper limit temperature before the circulation operation starts.

However, the method shown in FIG. 8 may not solve the problem that occurs in the period from the time t2 to the time t3, and furthermore, the problem that occurs in the period from the time t3 to the time t4 may not be solved.

Since the method shown in FIG. 8 is not a method of introducing the cold air into the first refrigerating compartment 11*a* in the period from the time t2 to the time t3, when the period from the time t2 to the time t3 increases, or when a difference between the first lower limit temperature and the first upper limit temperature decreases, it is impossible to prevent the first refrigerating compartment 11*a* from reaching the first upper limit temperature in the period from the time t2 to the time t3.

Also, since the first refrigerating compartment 11*a* is excessively cooled in the method shown in FIG. 8, there is a problem that the temperature of the first refrigerating compartment 11*a* may fall below the first lower limit temperature in a period from the time t3 to the time t4.

In addition, since this method is not a method for setting an appropriate circulation operation start time point, it is impossible to cope with a sudden increase in temperature of the first refrigerating compartment 11*a* while the refrigerant is supplied to the freezing compartment evaporator 14*b*.

Hereinafter, the method for solving the problem described in FIG. 7 is proposed.

For this, the refrigerator according to the present invention includes a first temperature sensor 18*a*, a second temperature sensor 18*b*, a freezing compartment temperature sensor 19, a three-way valve 22, first and second dampers 17*a* and 17*b*, a refrigerating compartment blowing fan 15*a*, and a freezing compartment blowing fan 15*b*.

However, the constituents are not essential elements necessary for solving the problem described in FIG. 7, and thus, description of some constituents may be omitted.

Hereinafter, a control method for the refrigerator to solve the problem in each of the period from the time t2 to the time t3 and the period from the time t3 to the time t4 will be described, and then the control method according to a time flow from the start time point to the end time point of the alternate operation will be described.

First, a refrigerator control method for solving the problem in the period from the time t2 to the time t3 will be described.

Figure 9:
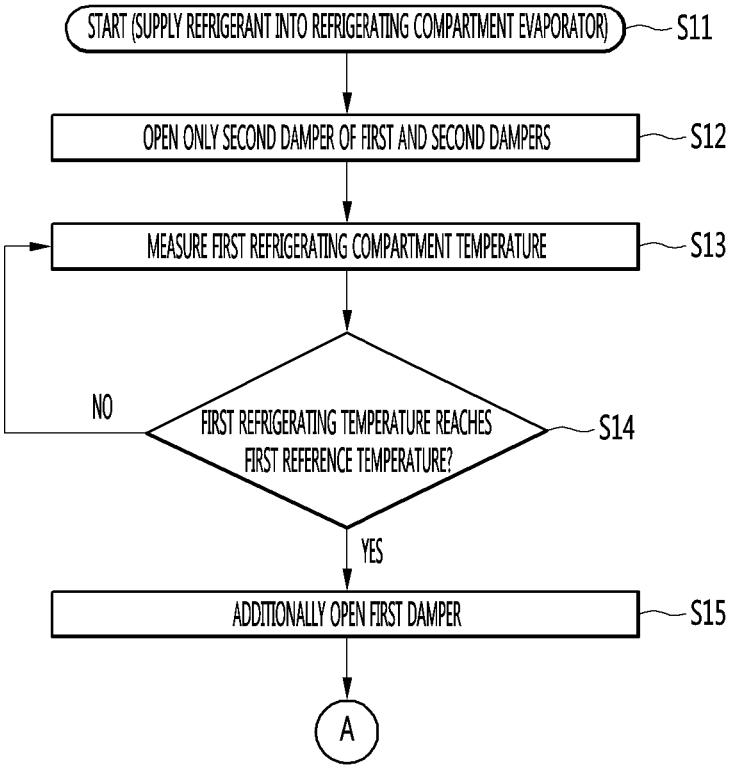
FIG. 9 is a control flowchart for solving a problem in a period from a time t2 to a time t3, which are described in FIG. 7.

FIG. 9 is a control flowchart for solving a problem in the period between t2 and t3, which are described in FIG. 7.

Referring to FIG. 9, the control unit 180 switches the three-way valve 22 from the first state to the second state at the alternate operation start time point to supply the refrigerant to the refrigerating compartment evaporator 14*a* (S11). Thus, cold air is generated in the refrigerating compartment evaporator 14*a*.

When the first refrigerating compartment 11*a* is cooled to the first target temperature at the time t2 described in FIG. 7, the control unit 180 controls the second damper 17*b* of the first and second dampers 17*a* and 17*b* to open (S12) only the second damper 17*b* of the first and second dampers 17*a* and 17*b* and close (S17*a*) the first damper 17 so that the cold air is introduced into only the second refrigerating compartment 11*b*.

Alternatively, when the first refrigerating compartment 11*a* is cooled up to the first target temperature, the control unit 180 may reduce the opening angle of the first cold-air passage by the first damper 17*a*. When the opening angle of the first cold-air passage by the first damper 17*a* is reduced, an amount of cold air flowing into the first refrigerating compartment 11*a* may be reduced to delay an increase in temperature of the first refrigerating compartment.

Here, the refrigerating compartment blowing fan 15*a* is always driven in a state in which at least one of the first and second dampers 17*a* and 17*b* is opened and is not driven when all the first and second dampers 17*a* and 17*b* are closed. Therefore, the description of the refrigerating compartment blowing fan 15*a* is omitted for convenience of explanation.

The first temperature sensor 18*a* measures the temperature of the first refrigerating compartment 11*a* in real time while the cold air is introduced into only the second refrigerating compartment 11*b* (S13). The control unit 180 receives a temperature from the first temperature sensor 18*a* to determine whether the temperature of the first refrigerating compartment 11*a* reaches the first set temperature. Here, the first set temperature is equal to or less than the upper limit temperature of the first refrigerating compartment 11*a*.

The first set temperature may be a temperature in consideration of the period from the time t2 to time t3 or the upper limit temperature of the first refrigerating compartment 11*a*. For example, the more the period from the time t2 to the time t3 increases, the more the first set temperature increases, and the more the upper temperature limit of the first refrigerating compartment 11*a* increases, the more the first set temperature decreases.

When the temperature of the first refrigerating compartment 11*a* does not reach the first set temperature, the control unit 180 continues to introduce the cold air into only the second refrigerating compartment 11*b*. On the other hand, when the temperature of the first refrigerating compartment 11*a* reaches the first set temperature (S14), the control unit 180 additionally opens the first damper 17*a* (S15) (or the opening angle of the first cold-air passage increases by the first damper 71*a*) to introduce the cold air into the first refrigerating compartment 11*a*.

As described above, a time for which the cold air is introduced into only the second refrigerating compartment 11*b* while the refrigerant is supplied to the refrigerating compartment evaporator 14*a* may correspond from a time point at which the first refrigerating compartment 11*a* is cooled to the first target temperature to a time point at which the first freezing compartment 11*a* reaches the first set temperature.

After the first damper 17*a* is additionally opened to introduce the cold air into the first refrigerating compartment 11*a* (or after the opening angle of the first cold-air passage increases by the first damper), an opening time of each of the first and second dampers 17*a* and 17*b* is determined according to the temperature of the second refrigerating compartment.

For another example, when a predetermined time elapses after the temperature of the first refrigerating compartment 11*a* reaches the first target temperature to close the first damper 17*a*, or the opening angle of the first cold-air passage increases by the first damper 17*a*, the control unit 180 more increases the opening angle of the first damper 17*a* or increases the opening angle of the first cold-air passage by the first damper 17*a* so that an amount of cold air introduced into the first refrigerating compartment 11*a* increases.

Figure 10:
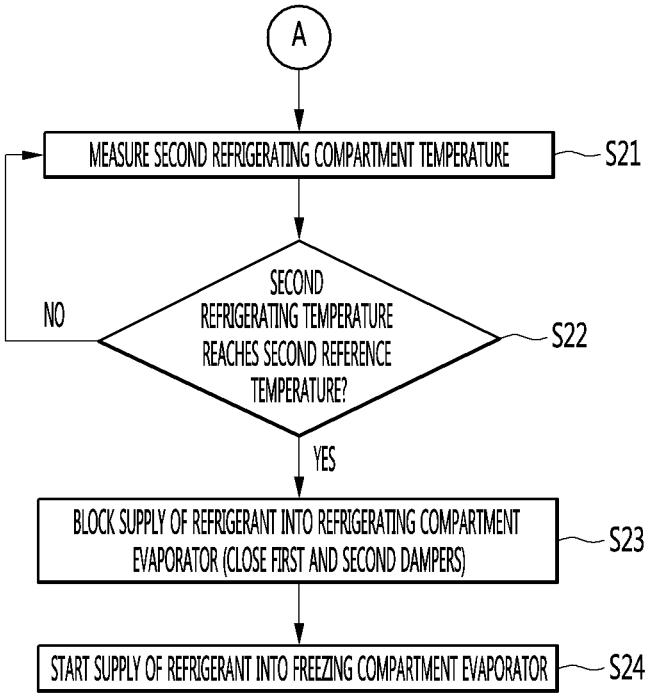
FIG. 10 is a control flowchart from a time point at which a first damper described in FIG. 9 is additionally opened to a time point at which supply of a refrigerant into a refrigerating compartment evaporator is blocked.

FIG. 10 is a control flowchart from a time point at which the first damper described in FIG. 9 is additionally opened to a time point at which supply of the refrigerant into the refrigerating compartment evaporator is blocked.

After the first damper 17*a* is additionally opened (A) in the state in which the cold air is introduced into only the second refrigerating compartment 11*b*, the control unit 180 receives the temperature measured (S21) from the second temperature sensor 18*b*.

When the second refrigerating compartment 11*b* is not cooled up to the target temperature, the control unit 180 continues to introduce the cold air into the first and second refrigerating compartment 11*a* and 11*b*. On the other hand, when the second refrigerating compartment 11*b* reaches the second target temperature (S22), the control unit 180 switches the three-way valve 22 into the third state. That is, when the second refrigerating compartment 11*b* reaches the second target temperature, the control unit 180 interrupts (S23) the refrigerant supply to the refrigerating compartment evaporator 14*a* and starts (S24) the refrigerant supply to the freezing compartment evaporator 14*b*.

Here, the control unit 180 closes the first and second dampers 17*a* and 17*b* together with the blocking of the supply of the refrigerant to the refrigerating compartment evaporator 14*a*. Thus, the introduction of the cold air into the first and second refrigerating compartments 11*a* and 11*b* is blocked.

In the present invention, when the temperature of the first refrigerating compartment 11*a* reaches a third set temperature less than the first set temperature as a temperature between the first upper limit temperature and the first lower limit temperature before the second refrigerating compartment 11*b* is cooled up to the target temperature, the control unit 180 may close the first damper 17*a* or reduce the opening angle of the first cold-air passage by the first damper 17*a*.

Alternatively, before the second refrigerating compartment 11*b* is cooled to the target temperature, when a predetermined time elapses at a time point at which the first damper 17*a* is additionally opened or at a time point at which the opening angle of the first cold-air passage increases, the control unit may close the first damper 17*a* or reduce the opening angle of the first cold-air passage by the first damper 17*a*.

As described with reference to FIG. 9, just after the cold air is supplied to the refrigerating compartment evaporator 14*a*, all the first and second dampers 17*a* and 17*b* are opened. Thereafter, only the second damper 170*b* is opened at a predetermined time point. Hereinafter, the time point at which only the second damper 17*b* is opened will be described in detail.

Figure 11:
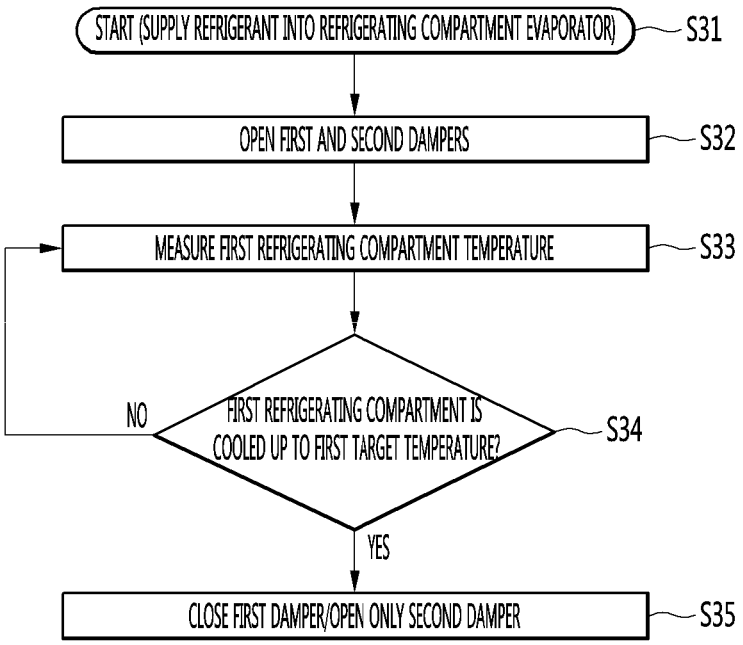
FIG. 11 is a control flowchart illustrating an exclusive open time point of a second damper described in FIG. 9.

FIG. 11 is a control flowchart illustrating an exclusive open time point of the second damper described in FIG. 9.

The control unit 180 allows the first and second dampers 17*a* and 17*b* to be opened (S32) when the refrigerant is supplied to the refrigerating compartment evaporator 14*a* (S31). Thus, the cold air generated in the refrigerating compartment evaporator 14*a* flows into each of the first and second refrigerating compartments 11*a* and 11*b*.

Here, a temperature reduction rate of the first and second refrigerating compartment 11*a* and 11*b* may be different from each other. This may be due to a volume difference of the first and second refrigerating compartment 11*a* and 11*b* and may be due to the location of the refrigerating compartment evaporator 14*a*.

Specifically, the more the volume of the refrigerating compartment increases, the more a temperature rate decrease due to the inflow of the cold air, and the more a distance from the refrigerating compartment evaporator 14*a* increases, the more the rate of temperature reduction increases. In the refrigerator described in this specification, the refrigerating compartment evaporator 14*a* is disposed on a sidewall of the first refrigerating compartment 11*a* so that the temperature reduction rate of the first refrigerating compartment 11*a* may be greater than that of the second refrigerating compartment 11*b*.

Therefore, even if the cold air is introduced into the first and second refrigerating compartments 11*a* and 11*b*, the temperature of the first refrigerating compartment 11*a* may reach the first target temperature more quickly.

As a result, the control unit 180 receives the temperature value measured (S33) from the first temperature sensor 18*a* after starting to supply the refrigerant to the refrigerating compartment evaporator 14*a*, and when the first refrigerating compartment 11*a* reaches (S34) the first target temperature, the first damper 17*a* is closed (S35) (or the opening angle of the first cold-air passage by the first damper is reduced), and the cold air is concentrated only in the second refrigerating compartment 11*b*. On the other hand, the control unit 180 introduces the cold air into each of the first and second refrigerating compartments 11*a* and 11*b* until the first refrigerating compartment 11*a* reaches the first target temperature.

In summary with respect to the period from the time 2 to the time t3, the present invention controls the time taken to introduce the cold air into only the second refrigerating compartment 11*b* on the basis of the temperature of the first refrigerating compartment 11*a* to solve the problem that occurs when an exclusive cooling time increases due to a difference in temperature reduction rate between the first and second refrigerating compartments 11*a* and 12*a*. Also, according to the present invention, since the exclusive cooling time for the second refrigerating compartment 11*b* is sufficiently secured after the first refrigerating compartment 11*a* reaches the first target temperature, the error range in temperature of the first refrigerating compartment 11*a* may be reduced.

Next, a control method for solving the problem occurring in the period from the time t3 to the time t4 will be described.

Figure 12:
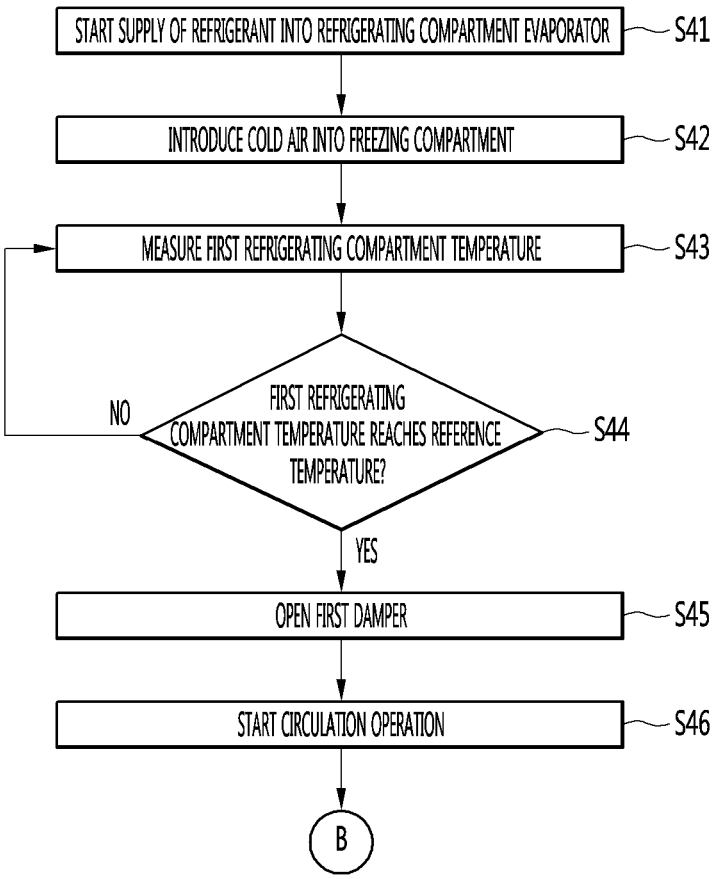
FIG. 12 is a control flowchart for solving a problem in a period from a time t3 to a time t4, which are described in FIG. 7.

FIG. 12 is a control flowchart for solving a problem in the period from the time t3 to the time t4, which is described in FIG. 7.

When the second refrigerating compartment 11*b* reaches the second target temperature, the three-way valve 22 is switched into the third state. That is, the control unit 180 starts (S41) the supply of the refrigerant into the freezing compartment evaporator 14*b*. Thus, the cold air is introduced (S42) into the freezing compartment.

The control unit 180 receives the temperature value measured (S43) by the first temperature sensor 18*a* to determine whether or not to start the circulation operation according to whether the received temperature value reaches the second set temperature. Particularly, when the temperature of the first refrigerating compartment 11*a* does not reach the second set temperature, the control unit 180 continues to introduce the cold air into the freezing compartment 11*c*.

On the other hand, when the temperature of the first refrigerating compartment 11*a* reaches (S44) the second set temperature, the control unit 180 opens (S45) the first damper 17*a* to introduce the cold air remaining in the refrigerating compartment evaporator into the first refrigerating compartment 11*a*.

Here, the second set temperature is equal to or less than the first set temperature and is not necessarily equal to the first set temperature. The second set temperature may be set in consideration of the cooling efficiency of the circulation operation. Specifically, the more the cooling efficiency of the circulation operation increases, the more the second set temperature may increase.

When the first refrigerating compartment 11*a* reaches the second set temperature, the control unit 180 may start (S46) the circulation operation while opening the first damper 17*a*. That is, the control unit 180 repeats the opening and closing of the first damper 17*a* at a predetermined time interval from the time point at which the first refrigerating compartment 11*a* reaches the second set temperature. Thus, the cold air remaining in the refrigerating compartment evaporator 14*a* is introduced into the first refrigerating compartment 11*a* at regular time intervals.

For another example, when a predetermined time elapses after the supply of the refrigerant into the freezing compartment evaporator 14*b* starts (or after the driving of the freezing compartment blowing fan starts), the control unit 180 starts (S46) the circulation operation while opening the first damper 17*a*.

The control unit 180 may interlock the opening and closing of the first damper 17*a* with the opening and closing of the second damper 17*b* in the circulation operation. For example, the control unit 180 opens the second damper 17*b* together whenever the first damper 17*a* is opened so that the cold air remaining in the refrigerating compartment evaporator 14*a* is introduced into each of the first and second refrigerating compartments 11*a* and 11*b*. Here, the refrigerating compartment blowing fan 15*a* is driven by being interlocked with the opening and closing of the first and second dampers 17*a* and 17*b*.

The circulation operation is continuous until the freezing compartment 11*c* reaches the third target temperature.

Figure 13:
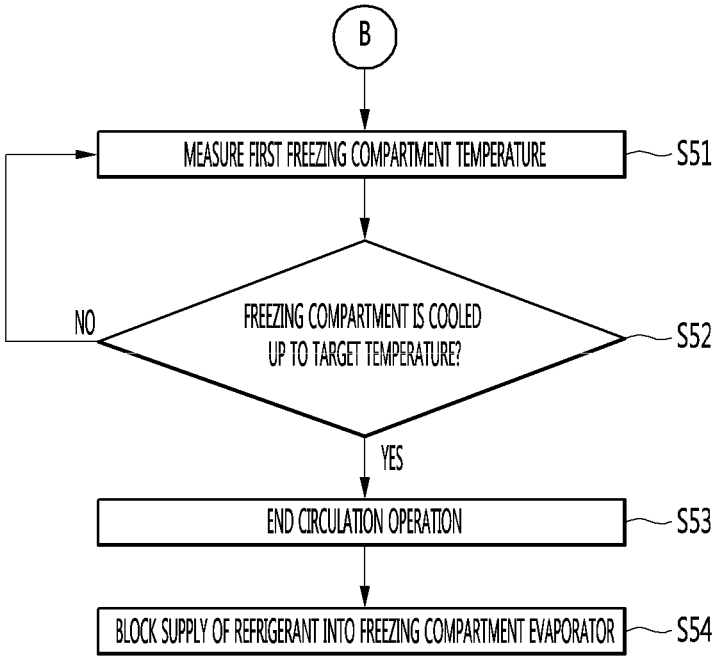
FIG. 13 is a control flowchart for explaining an end time point of a circulation operation described in FIG. 12.

FIG. 13 is a control flowchart for explaining an end time point of the circulation operation described in FIG. 12.

Referring to FIG. 13, after the circulation operation starts (B), the control unit 180 determines whether the circulation operation is completed according to the temperature of the freezing compartment 11*c*. Specifically, when the temperature of the freezing compartment 11*c* does not reach the third target temperature, the control unit 180 maintains the circulation operation while continuously introducing the cold air into the freezing compartment 11*c*.

On the other hand, when the freezing compartment 11*c* is cooled to the third target temperature S52, the control unit 180 ends (S53) the circulation operation, switches the three-way valve 22 from the third state to the first state, and maintains the closed state of each of the second dampers 17*a* and 17*b*. Thus, the introduction of the cold air into the first and second refrigerating compartments 11*a* and 11*b* and the freezing compartment 11*c* is blocked (S65).

In summary with respect to the period from the time t3 to the time t4, the refrigerator according to the present invention starts the circulation operation at the time point at which the temperature of the first refrigerating compartment 11*a* reaches the second set temperature so that the cold air is introduced into the first and second refrigerating compartments 11*a* and 11*b* at an appropriate time point. As a result, the temperature of each of the first and second refrigerating compartments 11*a* and 11*b* is prevented from falling below the lower limit temperature through the circulation operation, and also, the temperature of the first refrigerating compartment 11*a* is prevented from exceeding the upper limit temperature.

However, when the temperature sensed by the sensor for measuring the temperature of the refrigerating compartment evaporator reaches the set value, the circulation operation may be ended even before the freezing compartment 11*c* is cooled to the third target temperature.

The problems occurring in the period from the time t3 to the time t4 may also occur in the refrigerator having a single refrigerating compartment and a single freezing compartment. Specifically, in the refrigerator in which the cold air is alternately introduced into the refrigerating compartment and the freezing compartment, the circulation operation may be performed to prevent the refrigerating compartment from excessively increasing in temperature while the cold air is introduced into the freezing compartment. Thus, the start time point of the circulation operation may be a problem. Hereinafter, a control method of controlling the circulation operation start time point in the refrigerator having the single refrigerating compartment and a single freezing compartment will be described.

Figure 14:
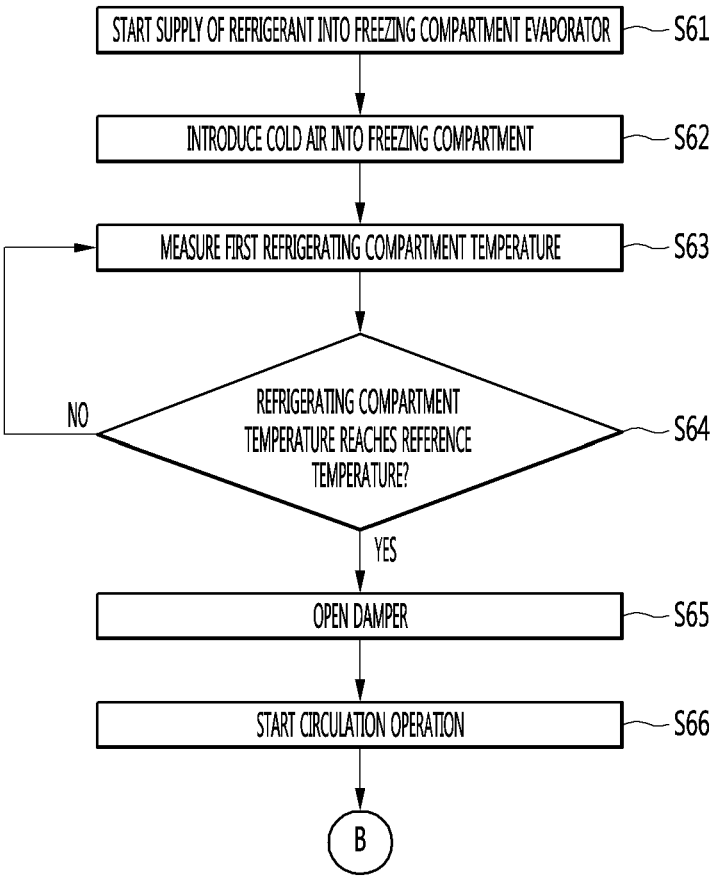
FIG. 14 is a control flowchart illustrating adjustment of a circulation start time point in the refrigerator provided with a single refrigerating compartment and a single freezing compartment.

FIG. 14 is a control flowchart illustrating adjustment of the circulation operation start time point in the refrigerator including the single refrigerating compartment and a single freezing compartment.

Since the refrigerator described in FIG. 14 includes one refrigerating compartment, the refrigerating compartment is not divided into the first and second refrigerating compartments, and the damper 17 is not divided into the first and second dampers. Also, the refrigerating compartment temperature sensor 18 is not divided into the first and second temperature sensors.

When the freezing compartment reaches the target temperature of the freezing compartment, the control unit 180 controls the three-way valve 22 to block the supply of the cold air into the refrigerating compartment evaporator 14*a* and to supply the cold air to the freezing compartment evaporator 14*b* (S61). Thus, the cold air is introduced (S62) into the freezing compartment.

Thereafter, the control unit 180 determines whether the circulation operation starts according to the temperature of the refrigerating compartment. Particularly, the control unit 180 receives the temperature value of the refrigerating compartment measured (S63) from the freezing compartment temperature sensor 18 and does not start the circulation operation when the temperature of the refrigerating compartment does not reach the reference temperature. On the other hand, when the temperature of the refrigerating compartment reaches (S64) the reference temperature, the damper is opened (S65) so that the cold air remaining in the refrigerating compartment evaporator 14*a* is introduced into the refrigerating compartment.

Thereafter, the control unit 180 repeatedly opens and closes the damper at a predetermined time interval so that the cold air remaining in the refrigerating compartment evaporator 14*a* is introduced into the refrigerating compartment at regular intervals. Here, the control unit 180 controls the refrigerating compartment blowing fan 15*a* to be driven together with the opening of the damper so as to stop the driving with the closing of the damper. That is, the control unit 180 starts (S66) the circulation operation.

Thereafter, when the freezing compartment reaches the target temperature of the freezing compartment, the control unit 180 switches the three-way valve 22 from the third state to the first state to maintain the closed state of the damper and stop the driving of the refrigerating compartment blowing fan 15*a*. Thus, the introduction of the cold air into the refrigerating compartment and the freezing compartment is blocked.

As described above, the control method described in FIG. 12 may be used to control the circulation operation time of the refrigerator having the single refrigerating compartment and the single freezing compartment.

Hereinafter, a control method according to a time flow from a start time point to an end time point of the alternate operation will be described.

Figure 15:
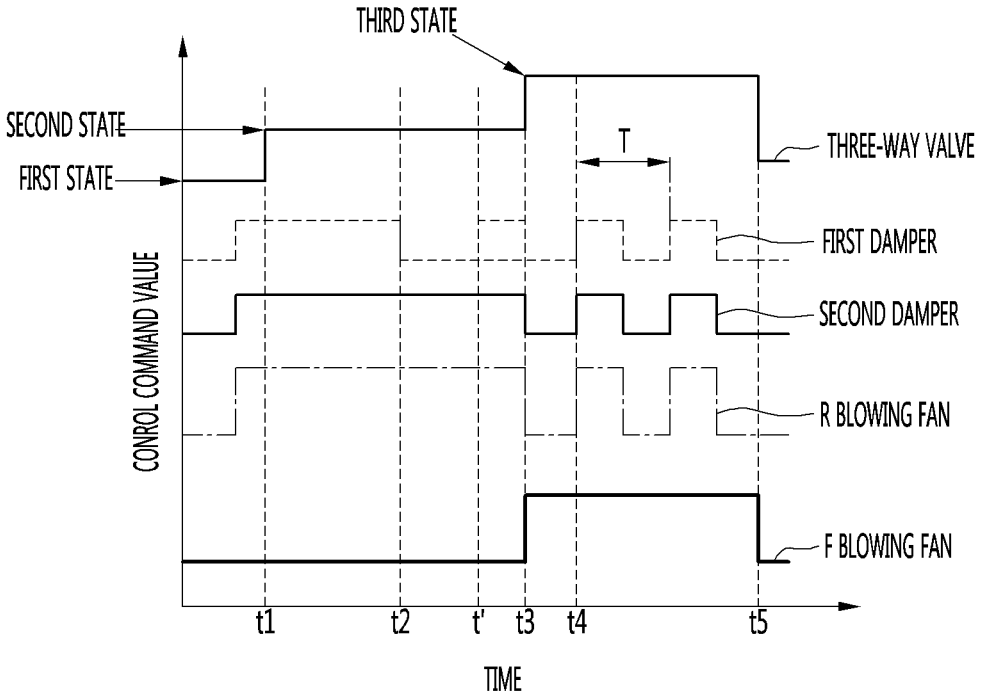
FIG. 15 is a control flowchart of the refrigerator based on a time according to the present invention.
Figure 16:
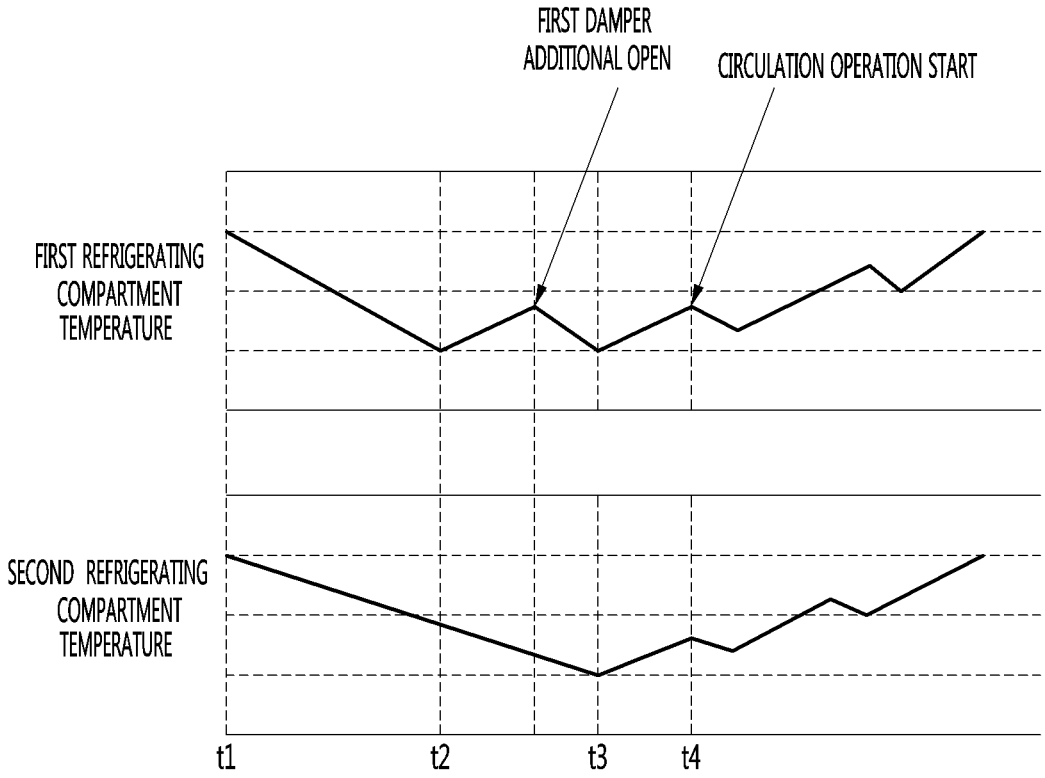
FIG. 16 is a conceptual view illustrating an operation state of the refrigerator and a variation in temperature of the refrigerating compartment according to the present invention.

FIG. 15 is a control flowchart of the refrigerator based on a time according to the present invention, and FIG. 16 is a conceptual view illustrating an operation state of the refrigerator and a variation in temperature of the refrigerating compartment according to the present invention.

Referring to FIG. 15, the control unit 180 transmits (t1) the second signal value to the three-way valve 22 to introduce the cold air into only the refrigerating compartment evaporator 14*a*. Here, all the signals transmitted to the first and second dampers 17*a* and 17*b* and the R blowing fan 15*a* are High signals.

Referring to FIG. 16, the control unit 180 controls the three-way valve 22 to generate (t1) the cold air in the refrigerating compartment evaporator 14*a*. Here, all the first and second dampers 17*a* and 17*b* are in the opened state. Thus, the cold air is introduced into each of the first and second refrigerating compartment 11*a* and 11*b* to reduce temperatures of the two refrigerating compartments.

Next, referring to FIG. 15, the first refrigerating compartment 11*a* reaches (t2) the first target temperature first, and the control unit 180 continues to transmit the second signal value to the three-way valve 22 to output a Low signal to the first damper 17*a* and continuously transmit the High signal to the second damper 17*b*. Here, the control unit 180 continues to transmit the High signal to the R blower fan 15*a*.

Figure 18:
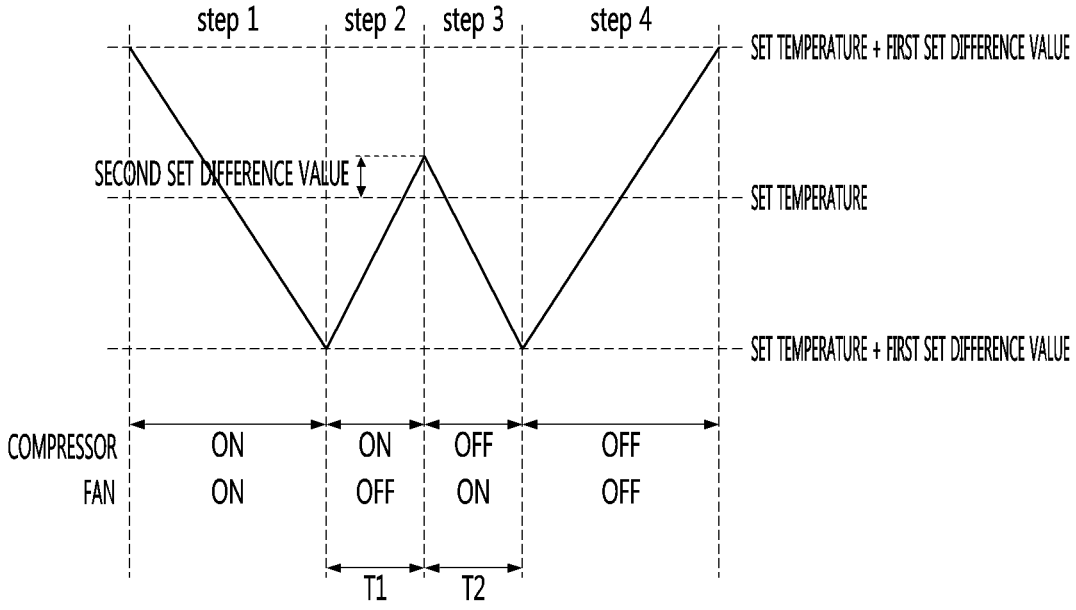
FIG. 18 is a view illustrating a variation in temperature of a storage chamber according to the method for controlling the refrigerator according to another embodiment of the present invention.

Referring to FIG. 18, the first refrigerating compartment 11*a* reaches the first target temperature first. Here, the control unit 180 closes the first damper 17*a* (or reduces the opening angle of the first cold-air passage by the first damper) to introduce the cold air into only the second refrigerating compartment 11*b*. Thus, the temperature of the first refrigerating compartment 11*a* starts to increase, and the temperature of the second refrigerating compartment 11*b* continuously decreases.

Next, referring to FIG. 15, when the temperature of the first refrigerating compartment 11*a* reaches (t') the first set temperature, the control unit 180 continues to transmit the second signal value to the three-way valve 22 and simultaneously changes the signal transmitted to the first damper 17*a* into the High signal. Here, the High signal is continuously transmitted to the second damper 17*b*. Here, the control unit 180 continues to transmit the High signal to the refrigerating compartment blower fan 15*a*.

Referring to FIG. 16, when the temperature of the first refrigerating compartment 11*a* reaches (t') the first set temperature, the control unit 180 additionally opens the first damper 17*a* (or increases the opening angle of the first cold-air passage by the first damper) to introduce the cold air into the first refrigerating compartment 11*a*. Thus, each of the first and second refrigerating compartments 11*a* and 11*b* decreases in temperature.

Next, referring to FIG. 15, when the temperature of the second refrigerating chamber 11*b* reaches (t3) the second target temperature, the control unit 180 changes the signal transmitted to the three-way valve 22 into the third signal and changes the signal transmitted to the first and second dampers 17*a* and 17*b* into the Low signal. Here, the control unit 180 changes the signal transmitted to the refrigerating compartment blowing fan 15*a* to the Low signal and changes the signal transmitted to the freezing compartment blowing fan 15*b* to the High signal.

Referring to FIG. 16, when the temperature of the second refrigerating compartment 11*b* reaches (t3) the second target temperature, the control unit 180 switches the three-way valve 22 from the second state to the third state, and the first and second dampers 17*a* and 17*b* are closed. Thus, the introduction of the cold air into the first and second refrigerating compartments 11*a* and 11*b* is blocked, and the introduction of the cold air into the freezing compartment 11*c* starts.

Next, referring to FIG. 15, when the temperature of the first refrigerating compartment 11*a* reaches (t4) the second set temperature, the control unit 180 continues to transmit the third signal value to the three-way valve 22 and simultaneously changes the signal transmitted to the first and second dampers 17*a* and 17*b* into the High signal. At this time, the control unit 180 alternately transmits the High and Low signals to the first and second dampers 17*a* and 17*b* at predetermined time intervals. Alternatively, each of the first and second dampers is opened at a predetermined time interval, and the opening angle of the first cold-air passage by each of the first and second dampers may increase or decrease at predetermined time intervals.

Here, the control unit 180 transmits a signal such as the signal transmitted to the first and second dampers 17*a* and 17*b* to the refrigerating compartment blowing fan 15*a*.

Referring to FIG. 16, when the temperature of the first refrigerating compartment 11*a* reaches (t4) the second set temperature, the control unit 180 starts the circulation operation so that the cold air remaining in the refrigerating compartment evaporator 14*a* is introduced into the first and second refrigerating compartments 11*a* and 11*b* in the even state in which the refrigerating is supplied to only the freezing compartment evaporator 14*b*, thereby continuously reducing the temperature of each of the first and second refrigerating compartments 11*a* and 11*b*.

Finally, referring to FIG. 15, when the temperature of the freezing compartment 11*c* reaches (t5) the third target temperature, the control unit 180 changes the signal transmitted to the three-way valve 22 to the first signal value and changes the signal transmitted to the first and second dampers 17*a* and 17*b* to the Low signal. Also, the control unit 180 transmits the Low signal to each of the refrigerating compartment blowing fan 15*a* and the freezing compartment blowing fan 15*b*. Thus, the three-way valve 22 is switched from the third state to the first state, and the driving of the first and second dampers 17*a* and 17*b*, the refrigerating compartment blowing fan 15*a*, and the freezing compartment blowing fan 15*b* is stopped. That is, the control unit 180 ends the circulation operation and blocks the supply of the cold air into all the storage chambers.

As described above, when the first refrigerating compartment 11*a* reaches the first set temperature or the second set temperature while the cold air is introduced into only one of the second refrigerating compartment 11*b* and the freezing compartment 11*c*, the first damper 17*a* is opened to introduce the cold air into the first refrigerating compartment 11*a*.

Thus, even if the temperature reduction rate between the first and second refrigerating compartments is large, the temperature of the first refrigerating compartment may be prevented from excessively increasing while the second refrigerating compartment is concentratedly cooled.

Also, in the present invention, the start time point of the circulation operation may be determined according to the temperature of the first refrigerating compartment. Thus, the present invention may prevent the first and second refrigerating compartments from being overcooled or excessively increasing in temperature through the circulation operation.

Figure 17:
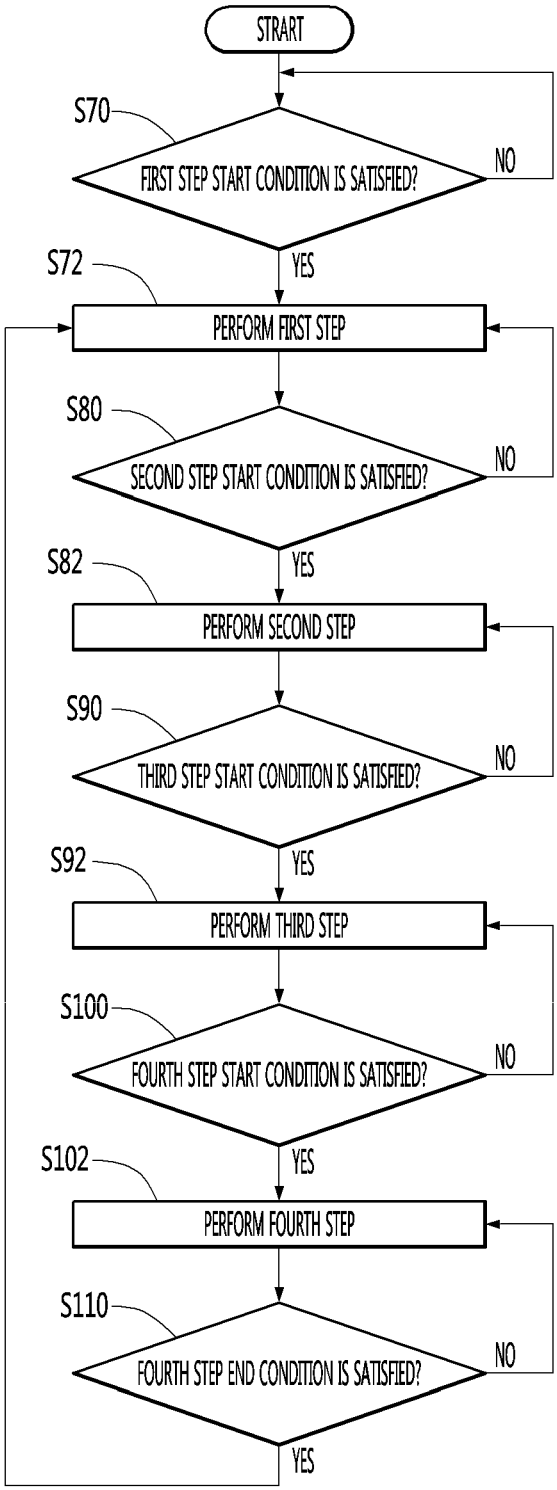
FIG. 17 is a flowchart illustrating a method for controlling a refrigerator according to another embodiment of the present invention.

FIG. 17 is a flowchart illustrating a method for controlling a refrigerator according to another embodiment of the present invention, and FIG. 18 is a view illustrating a variation in temperature of a storage chamber according to the method for controlling the refrigerator according to another embodiment of the present invention.

Referring to FIGS. 17 and 18, total four steps may be successively performed to maintain a temperature of the storage chamber, which is selected as one of a refrigerating compartment and a freezing compartment, at a constant temperature in this embodiment.

The refrigerator may form one cooling cycle by using a single compressor and a single evaporator.

Alternatively, for example, two compressors and two evaporators may be used to form two cooling cycles.

In this specification, in case in which the storage chamber is the refrigerating compartment, the compressor and a fan may be a compressor for the refrigerating compartment and a fan for the refrigerating compartment. Also, in case in which the storage chamber is the freezing compartment, the compressor and a fan may be a compressor for the freezing compartment and a fan for the freezing compartment.

A control method of the refrigerator according to the present invention may include a first step for driving the compressor compressing a refrigerant and the fan moving air, a second step of driving the compressor and stopping the fan, a third step of stopping the compressor and driving the fan, and a fourth step of stopping the compressor and the fan.

When the fourth step is ended, the first step may be performed just.

In the first step, the storage chamber decreases in temperature, and in the second step, the storage chamber increases in temperature. In the third step, the storage chamber decreases in temperature, and in the fourth step, the storage chamber increases in temperature. Thus, in the control method, the above-described temperature distribution may be realized.

The first step starts when a start condition of the first step is satisfied (S70). The start condition of the first step may represent a temperature (a first reference temperature) obtained by adding a temperature variation range that is allowed at a set temperature of the storage chamber, i.e., a first set difference value. That is, when the temperature of the storage chamber increases by a difference value between a set temperature and a first set temperature, the first step is performed (S72).

Here, the first set temperature difference value may be approximately 0.5.

In the first step, since the compressor is driven, the evaporator may be cooled, and the temperature of the storage chamber may decrease while the air cooled through the evaporator moves to the storage chamber by the fan. Here, the temperature of the storage chamber may be changed in a curved shape rather than a straight line as illustrated in FIG. 7, but it is expressed by a straight line in FIG. 7 for convenience of explanation.

While the first step is performed, it is determined where a start condition of the second step is satisfied (S80). Here, the start condition of the second step is the same as an end condition of the first step. This is done because when the first step is ended, the second step is performed immediately.

The first step may be ended at a temperature (a second reference temperature) of the temperature of the storage chamber, which is obtained by subtracting the first set difference value from the set temperature. That is, the second step may start at a temperature of the storage chamber, which is obtained by subtracting the first set difference value from the set temperature.

Thus, in the first step, the storage chamber may be changed within a range of a temperature obtained by adding the first set difference value to the set temperature and a temperature obtained by subtracting the first set difference value from the set temperature. Here, if the first set difference value is approximately 0.5, in the first step, the temperature may be changed within a range of 1 degree based on the set temperature of the storage chamber.

In the second step, the compressor is maintained to be driven, but the driving of the fan is stopped (S82). Since the compressor is driven, air around the evaporator is cooled at a low temperature in the evaporator. However, since the fan is not driven, most of the air cooled by the evaporator may not move to the storage chamber and be located around the evaporator.

Thus, the temperature of the storage chamber increases relative to the temperature at the beginning of the second step.

While the second step is performed, it is determined where a start condition of the third step is satisfied (S90). Here, the start condition of the third step is the same as an end condition of the first step. This is done because when the second step is ended, the third step is performed immediately.

That is, the second step may be ended when the temperature of the storage chamber reaches a temperature obtained by adding the second set difference value to the set temperature. Here, the second set difference value may increase as an external temperature of the refrigerator increases. The increase in the second set difference value may represent that the performed time of the second step increases.

TABLE 1

| External temperature (° C.) | T < 18 | 18 < T < 22 | 22 < T < 34 | 34 < T |
|---|---|---|---|---|
| Second set difference value | Decreases <–> Increase | | | |

When an external temperature T increases, a more amount of cold air for cooling the storage chamber is required. That is, when the external temperature is high, the compressor has to be further driven to cool the storage chamber at the same temperature.

In the second step, even through the compressor is not driven in the third step, it is necessary to secure sufficient cold air for cooling the storage chamber. Therefore, to accumulate more cold air in the second step, as the external temperature increases, the performed time of the second step has to be longer. For this, the second set difference value may be changed largely from the set temperature and the second set difference value, which are the end conditions of the second step, to end the second step after waiting until the temperature of the storage chamber further increase.

Also, the user tends to be relatively sensitive to noise when the compressor repeats the driving and stopping with frequent cycles. Also, since energy efficiency is deteriorated by repeatedly driving and stopping the compressor, it is preferable that the compressor is stopped after driving enough to avoid driving for a long time after ensuring sufficient cold air after starting the compressor.

As shown in Table 1, the second set difference value may be changed in size with the total four sections. For example, the second set difference value may be selected according to a temperature measured by an external temperature sensor while having only four variation values.

The second set difference value may be less than the first set difference value. That is, the temperature of the storage chamber at the end time point of the second step is preferably less than that of the storage chamber at the start time point of the first step.

It is preferable that the temperature variation range in the first step includes the temperature variation range in the second step so that the temperature variation range of the storage chamber decreases. Thus, the storage chamber may be changed within a narrow range around the set temperature, and the temperature variation range of the storage chamber may be reduced.

It may be determined whether the second step is performed for the first set time T1 as another end condition of the second step (S90).

TABLE 2

| External temperature (° C.) | T < 18 | 18 < T < 22 | 22 < T < 34 | 34 < T |
|---|---|---|---|---|
| First set time (T1) | Decreases <–> Increase | | | |

When the external temperature T increases, a more amount of cold air for cooling the storage chamber is required. That is, when the external temperature is high, the compressor has to be further driven to cool the storage chamber at the same temperature.

In the second step, even through the compressor is not driven in the third step, it is necessary to secure sufficient cold air for cooling the storage chamber. Therefore, to accumulate more cold air in the second step, as the external temperature increases, the performed time of the second step, i.e., a first set time T1 has to be longer.

As shown in Table 2, the first set time may be changed in size with the total four sections. For example, the first set time may be selected according to a temperature measured by the external temperature sensor while having only four change values.

The first set time T1 may be measured by a timer. The timer starts to measure an elapsed time when the second step starts, i.e., the compressor is driven, and the stop of the fan starts, and transmit information about whether the first set time T1 elapses to a control unit.

In the second step, the driving of the compressor is stopped, and the fan is driven (S92). Since the compressor is not driven, the cold air is not generated in the evaporator so that it is difficult to continuously cool air around the evaporator. In the second step, since the air around the evaporator is in the cooled state, when the fan is driven, the cooled air may move to the storage chamber to cool the storage chamber. Thus, as illustrated in FIG. 18, the internal temperature of the storage chamber may decrease.

In the third step, since the compressor is not driven, noise due to the compressor is not generated. Generally, since the noise generated by the compressor is less than that generated by the fan, the noise level in the third step may be less than that in the second step.

While the third step is performed, it is determined where a start condition of the fourth step is satisfied (S100). Here, the start condition of the fourth step is the same as an end condition of the third step. This is done because when the third step is ended, the fourth step is performed immediately.

The third step may be ended when the temperature of the evaporator reaches a specific temperature. The temperature of the evaporator may be measured by a temperature sensor for the evaporator. The specific temperature may represent a temperature at which the sublimation phenomenon of ice formed on the evaporator due to the operation of the fan is generated so that reliability of dew or icing in the storage chamber is not affected. The specific temperature may specifically be 0 degree or more, i.e., a temperature above zero.

Here, the temperature sensor for the evaporator may measure a temperature of the tube through which the refrigerant flows into the evaporator or a temperature of a side of the evaporator.

Also, the third step may be performed and ended during the second set time T2.

TABLE 3

| External temperature (° C.) | T < 18 | 18 < T < 22 | 22 < T < 34 | 34 < T |
|---|---|---|---|---|
| Second set time (T2) | Decreases <–> Increase | | | |

When the external temperature T increases, a more amount of cold air for cooling the storage chamber is required.

That is, when the external temperature is high, the compressor has to be further driven to cool the storage chamber at the same temperature. If it is determined that the external temperature is high in the second step, since the first set time is long, the compressor is driven for a longer time, and more cold air is accumulated. Thus, to sufficiently transfer the cold air accumulated in the second step to the storage chamber in the third step, it is possible to drive the fan for a longer time. That is, since more cold air is contained, the fan is further driven, and the cold air around the evaporator sufficiently moves to the storage chamber to cool the storage chamber.

As shown in Table 3, the second set time may be changed in size with the total four sections. For example, the second set time may be selected according to a temperature measured by the external temperature sensor while having only four change values.

It is also possible that the start condition of the fourth step starts when the temperature of the storage chamber reaches a value obtained by subtracting the first set difference value from the set temperature in addition to the above-mentioned two conditions. Since the related contents are the same as those in the case of starting the second step, detailed description will be omitted.

When the fourth step is performed, since the fan and the compressor are not driven, noise is not generated (S102). On the other hand, since the cold air is not supplied to the storage chamber, the temperature of the storage chamber may increase.

While the fourth step is performed, it is determined where an end condition of the fourth step is satisfied (S110). Here, the end condition of the fourth step is the same as a start condition of the first step. This is done because when the fourth step is ended, the first step is performed immediately.

That is, the fourth step may be ended at a temperature obtained by adding the first set difference value to the set temperature. Thus, the variation range of the internal temperature of the storage chamber may be included in the temperature variation range in the first step.

The temperature variation range in the first step may be the same as the temperature variation range in the fourth step.

In the present invention, since the compressor is driven only in the first stage and the second stage, and the compressor is not driven in the third stage and the fourth stage, the cycle for driving and stopping the compressor may be longer. Thus, the noise due to the driving of the compressor may be reduced.

In addition, since the driving period of the compressor increases, the energy efficiency consumed in operating the compressor may be improved. If the compressor is frequently turned on and off, the power consumed to drive the compressor may increase significantly.

Also, the temperature variation range of the first step includes a temperature variation range in the second step, the third step, and the third step so that the temperature of the storage chamber as a whole is changed within the temperature variation range in the first step. Alternatively, the temperature of the storage chamber may be changed within the temperature variation range in the fourth step. Therefore, the temperature range of the storage chamber may be reduced so that the temperature of the food stored in the storage chamber is maintained within a certain range, and the storage period of the food increases.

Particularly, the storage chamber may be a refrigerator compartment. Since the refrigerator has the temperature above zero as the set temperature, the food is stored at a temperature greater than that of the freezing compartment. Therefore, the food stored in the refrigerator is more sensitive to the temperature variation of the storage chamber than the food stored in the freezing compartment. The control flow described in the present invention may be applied to the refrigerating compartment to reduce the temperature variation range of the refrigerating compartment.

In this specification, although the two embodiments are described separately, but the present invention is not limited thereto, and the contents of the second embodiment may be added to the first embodiment, or two embodiments may be combined with each other.

Also, the detailed description is intended to be illustrative, but not limiting in all aspects. It is intended that the scope of the present invention should be determined by the rational interpretation of the claims as set forth, and the modifications and variations of the present invention come within the scope of the appended claims and their equivalents.

The invention claimed is:

1. A method for controlling a refrigerator comprising a first evaporator that is configured to receive compressed refrigerant to generate first cold air for cooling a first storage chamber having a high-temperature chamber and a low-temperature chamber, wherein a temperature of the low-temperature chamber is less than a temperature of the high-temperature chamber, a first cooling fan configured to supply the first cold air into the first storage chamber, a second evaporator configured to receive the compressed refrigerant to generate second cold air for cooling a second storage chamber that is maintained at a temperature different from the temperature of the low-temperature chamber, the high-temperature chamber, or both, a second cooling fan configured to supply the second cold air into the second storage chamber, and one or more dampers configured to selectively open at least one of a first cold-air passage configured to supply the first cold air to the high-temperature chamber or a second cold-air passage configured to supply the first cold air to the low-temperature chamber, wherein each of the high-temperature chamber and the low-temperature chamber has a first reference temperature and a second reference temperature less than the first reference temperature, the method comprising:

driving the first cooling fan to cool the first storage chamber;

adjusting the one or more dampers to supply the first cold air simultaneously through the first and second cold-air passages;

adjusting the one or more dampers to decrease an amount of the first cold air flowing through the first cold-air passage based on the temperature of the high-temperature chamber reaching a value less than or equal to the second reference temperature of the high-temperature chamber;

adjusting the one or more dampers to decrease an amount of the first cold air flowing through the second cold-air passage, based on the temperature of the low-temperature chamber reaching a value less than or equal to the second reference temperature of the low-temperature chamber;

driving the second cooling fan to cool the second storage chamber;

determining whether a predetermined amount of time has elapsed after the temperature of the high-temperature chamber reaches the value less than or equal to the second reference temperature of the high-temperature chamber, or whether the temperature of the high-temperature chamber reaches a first set temperature between the first reference temperature of the high-temperature chamber and the second reference temperature of the high-temperature chamber; and based on determining that the predetermined amount of time has elapsed after the temperature of the high-temperature chamber reaches the value less than or equal to the second reference temperature of the high-temperature chamber, or based on determining that the temperature of the high-temperature chamber reaches the first set temperature, adjusting the one or more dampers to increase the amount of the first cold air flowing through the first cold-air passage.

2. The method of claim 1, further comprising:

increasing an output of the first cooling fan and adjusting the one or more dampers to increase the amount of the first cold air flowing through at least one of the first cold-air passage or the second cold-air passage based on an elapse of a preset amount of time after the driving of the second cooling fan starts, or based on the temperature of the high-temperature chamber reaching a second set temperature between the first reference temperature of the high-temperature chamber and the second reference temperature of the high-temperature chamber.

3. The method of claim 2, wherein the one or more dampers comprise:

a first damper configured to open and close the first cold-air passage; and a second damper configured to open and close the second cold-air passage, and wherein adjusting the one or more dampers to increase the amount of the first cold air flowing through at least one of the first cold-air passage or the second cold-air passage comprises:

opening each of the first damper and the second damper.

4. The method of claim 2, wherein, adjusting the one or more dampers to increase the amount of the first cold air flowing through at least one of the first cold-air passage or the second cold-air passage comprises:

increasing or decreasing the amount of the first cold air flowing through at least one of the first cold-air passage or the second cold-air passage based on a predetermined period.

5. The method of claim 2, further comprising:

after the one or more dampers is adjusted to increase the amount of the first cold air flowing through at least one of the first cold-air passage or the second cold-air passage, decreasing the output of each of the first and second cooling fans based on the temperature of the second storage chamber reaching a value that is equal to or below a reference temperature of the second storage chamber.

6. The method of claim 5, further comprising:

after the one or more dampers is adjusted to increase the amount of the first cold air flowing through at least one of the first cold-air passage or the second cold-air passage, adjusting the one or more dampers to decrease the amount of the first cold air flowing through at least one of the first cold-air passage or the second cold-air passage based on the temperature of the first evaporator reaching a set value before the temperature of the second storage chamber reaches the value that is below the reference temperature of the second storage chamber.

7. The method of claim 1, further comprising:

after the one or more dampers is adjusted to increase the amount of the first cold air flowing through the first cold-air passage, adjusting the one or more dampers to decrease the amount of the first cold air flowing through the first cold-air passage based on the predetermined amount of time elapsing after the one or more dampers is adjusted to increase the amount of the first cold air flowing through the first cold-air passage, or based on the temperature of the high-temperature chamber reaching a third set temperature that is previously set between the first set temperature of the high-temperature chamber and the second reference temperature of the high-temperature chamber.

8. The method of claim 1, wherein the one or more dampers comprise:

a first damper configured to open and close the first cold-air passage; and a second damper configured to open and close the second cold-air passage.

9. The method of claim 8, wherein adjusting the one or more dampers to decrease the amount of the first cold air flowing through the first cold-air passage comprises:

maintaining the amount of the first cold air flowing through the second cold-air passage by the second damper.

10. The method of claim 9, wherein adjusting the one or more dampers to decrease the amount of the first cold air flowing through the first cold-air passage comprises:

closing the first damper based on the temperature of the high-temperature chamber reaching the value that is equal to or below the second reference temperature of the high-temperature chamber.

11. The method of claim 10, wherein adjusting the one or more dampers to increase the amount of the first cold air flowing through the first cold-air passage comprises:

opening the first damper after the temperature of the high-temperature chamber reaches the value that is equal to or below the second reference temperature of the high-temperature chamber.

12. The method of claim 8, wherein adjusting the one or more dampers to decrease the amount of the first cold air flowing through the second cold-air passage comprises:

closing each of the first damper and the second damper based on the temperature of the low-temperature chamber reaching the value that is equal to or below the second reference temperature of the low-temperature chamber.

13. The method of claim 1, wherein adjusting the one or more dampers to increase the amount of the first cold air flowing through the first cold-air passage comprises:

based on determining that the temperature of the high-temperature chamber reaches the first set temperature, opening the one or more dampers to increase the amount of the first cold air flowing through the first cold-air passage.

14. The method of claim 1, wherein adjusting the one or more dampers to increase the amount of the first cold air flowing through the first cold-air passage comprises:

based on determining that the predetermined amount of time has elapsed after the temperature of the high-temperature chamber reaches the value less than or equal to the second reference temperature of the high-temperature chamber, opening the one or more dampers to increase the amount of the first cold air flowing through the first cold-air passage.

15. The method of claim 9, further comprising:

while controlling the second damper to maintain the amount of the first cold air flowing through the second cold-air passage, (i) opening the first damper until the temperature of the high-temperature chamber reaches the value that is equal to or below the second reference temperature of the high-temperature chamber, (ii) closing the first damper based on the temperature of the high-temperature chamber reaching the value that is equal to or below the second reference temperature of the high-temperature chamber, and (iii) opening the first damper after the temperature of the high-temperature chamber reaches the value that is equal to or below the second reference temperature of the high-temperature chamber.

16. The method of claim 1, wherein cooling of the first storage chamber and cooling of the second storage chamber are alternately performed.

17. The method of claim 1, wherein cooling of the first storage chamber and cooling of the second storage chamber are simultaneously performed.

18. The method of claim 1, wherein cooling of the high-temperature chamber and cooling of the low-temperature chamber are simultaneously performed.

19. The method of claim 1, wherein cooling of the high-temperature chamber and cooling of the low-temperature chamber are alternately performed.

* * * * *